US005829997A

United States Patent [19]

Okano et al.

[11] Patent Number: 5,829,997

[45] Date of Patent: Nov. 3, 1998

[54] CONNECTING APPARATUS

[75] Inventors: Takeshi Okano, Kanagawa; Takeshi Matsuda, Tokyo, both of Japan

[73] Assignees: Victor Company of Japan, Kanagawa-ken; SMK Corporation, Tokyo, both of Japan

[21] Appl. No.: 755,738

[22] Filed: Nov. 25, 1996

[30] Foreign Application Priority Data

Nov. 24, 1995 [JP] Japan ..... 7-327916
Nov. 24, 1995 [JP] Japan ..... 7-327917

[51] Int. Cl.[6] ..... H01R 13/62

[52] U.S. Cl. ..... 439/310; 439/929; 439/297; 361/615; 361/740

[58] Field of Search ..... 439/310, 259, 439/929, 266, 372, 341, 346, 347, 350, 297, 298; 361/615–617, 736–759

[56] References Cited

U.S. PATENT DOCUMENTS 4,602,351 7/1986 Shimamura et al. ..... 439/326
4,969,830 11/1990 Daly et al. ..... 439/341
5,306,174 4/1994 Kiga ..... 439/341
5,578,391 11/1996 Meyers et al. ..... 439/929
5,627,727 5/1997 Aguliera et al. ..... 439/929
5,710,229 12/1997 Yamamoto ..... 439/298

*Primary Examiner*—Neil Abrams
*Assistant Examiner*—Brian J. Biggi
*Attorney, Agent, or Firm*—Armstrong, Westerman Hattori, McLeland & Naughton

[57] ABSTRACT

A connecting apparatus which permits the connection of a connector unit (9) to a connector of external equipment (2) by the actuation of an operating lever (11) only when the external equipment (2) is placed in a mounting recess (6), whereas when no external equipment is placed in the recess (6), associated parts for moving the connector unit (9) do not respond to the actuation of the operating lever (11). Hence, movable terminals of the connector unit (9) will not be exposed to the outside even if the operating lever (11) is actuated inadvertently. The connecting apparatus is provided with a sensor mechanism for sensing the presence of the external equipment (2), and a switching mechanism operatively associated with the sensor mechanism to selectively engage the operating lever (11) with a part (12) for moving the connector unit (9) or disengage them from each other. Only when the presence of the external equipment (2) is detected, the switching mechanism engages the operating lever (11) with the part (12) to connect the connector unit (9) to the connector of the external equipment (2).

7 Claims, 23 Drawing Sheets

Fig.5
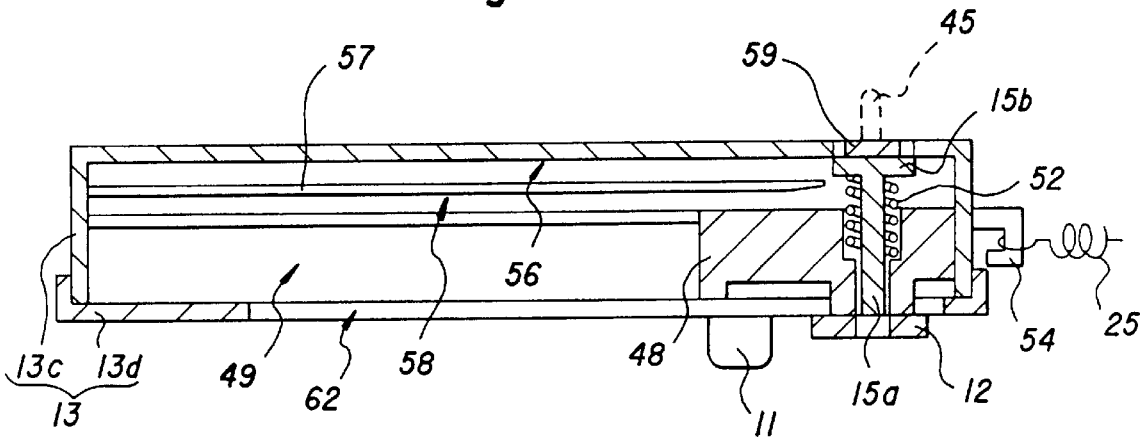
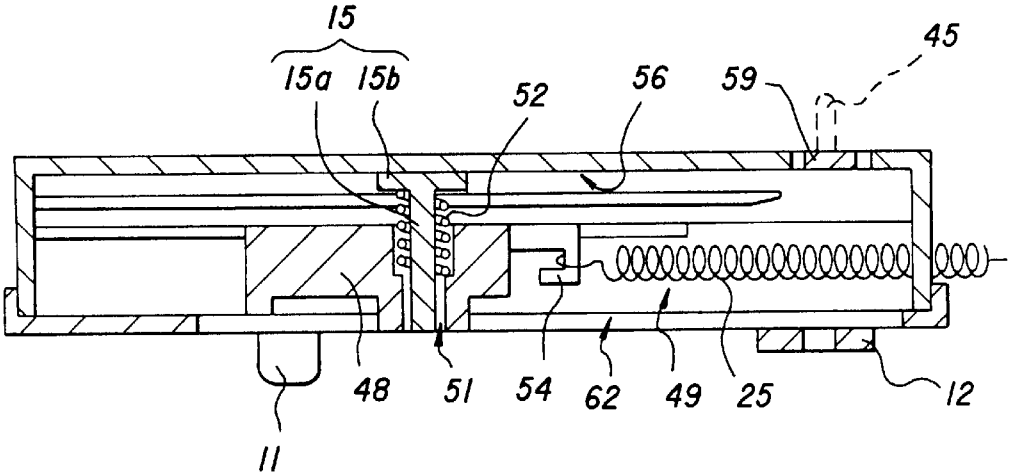
Fig.6

CONNECTING APPARATUS

BACKGROUND OF THE INVENTION

1. Field of the Invention

The present invention relates to a connecting apparatus to which external equipment such as a video camera is attached for electrical connection to a power supply or signal conductor and, more particularly, to a connecting apparatus for connecting the connector unit thereof to a connector of external equipment by actuating an operating lever.

2. Description of the Prior Art

FIG. 28 shows an example of a connecting apparatus for connecting a station 100 as the connecting apparatus to a portable video camera 120 as external equipment. As shown, the video camera 120 is mounted on a case body 110 of the station 100 and the video camera 120 is electrically connected to a TV receiver 130 through the station 100. With such a connection, it is possible to reproduce image and sound signals recorded by the video camera 120 on the TV receiver 130.

To establish such an electrical connection, the station 100 has on the case 110 thereof, a connector unit 140 which has contact portions of its movable terminals projected out of the case structure, whereas the video camera 120 has on the underside thereof an output connector 150 having fixed terminals for elastic contact with the movable terminals of the connector unit 140.

With the station 100 of such a construction, however, there is a possibility that when the external equipment 120 is not mounted thereon, the movable terminals thus exposed on the top of the case 110 may be shorted out if touched by a conductive foreign matter or internal circuits or the movable terminals themselves are broken down or deformed if inadvertently touched by a finger charged with static electricity. To preclude this possibility, the prior art adopts a mechanism which houses the movable contacts in the connector unit 140 itself when the external equipment 120 is not mounted on the case 110.

To facilitate a better understanding of the present invention, a description will be given first, with reference to FIGS. 28 through 32, of a station 200 which is a conventional connecting apparatus with a mechanism for outwardly projecting and inwardly retracting the movable terminals.

As depicted in FIG. 29, the station 200 has a case 210, a coupling plate 220 slidably mounted thereon and a connector unit 230 mounted on the coupling plate 220.

The case 210 has, in its top surface, a recess 211 for receiving external equipment 300 such as a video camera. The recess 211 is so positioning rails 212 protrusively provided on a pair of opposed side walls of the cavity 211 for engagement with the external equipment 300 to hold it in place.

The coupling plate 220 is slidably mounted on the underside of the case 210 by guide pins 214*a*, 214*b* and 214*c* loosely fitted into three elongated holes 213*a*, 213*b* and 213*c* of the coupling plate 220 and thread-mounted on the underside of the case 210. The coupling plate 220 is always pulled to the right-hand side in FIG. 29 by a return spring 215 stretched between the coupling plate 220 and the case 210. On the coupling plate 220 there is mounted a connector unit 230 provided with movable terminals 400 in such a manner that it protrudes from an opening 260 in the top surface of the case 210.

The coupling plate 220 of the above-described construction is pivotally mounted on the intermediate portion of a link plate 216 pivotally secured at one end to the case 210 and engaged at the other end with an operating lever 217. Hence, when the operating lever 217 is moved to right or left, the link plate 216 is turned, and consequently, the coupling plate 220 slides in the same direction as that in which the operating lever 217 is moved.

The operating lever 217 has a locking pawl 219 formed integrally therewith for engagement with a lock lever 218 to lock the operating lever 217 brought to the position of connection described later on against the force of the return spring 215.

As shown in FIGS. 30 and 31, the connector unit 230 has a plurality of slits 240 made in the top surface thereof for outwardly projecting and inwardly retracting therethrough movable terminals 400. On a pair of opposed sides of the connector unit 230, there are protrusively provided levers 250, which are actuated to outwardly project the movable terminals 400 through the slits 240.

FIG. 31 is a sectional view taken along the line R—R in FIG. 30, showing the internal structure of the connector unit 230. In the connector unit 230 there are mounted the movable terminals 400, an actuator 410 for engagement with the lower end portions of the movable terminals 400, and a press spring 420 for pressing the actuator 410 toward the movable terminals 400.

The actuator 410 is provided to retract the movable terminals 400 into the connector unit 230 against the elasticity of the movable terminals 400. The lower end portion of the forward end face of the actuator 410 facing the movable terminals 400 forms a locking surface 411 which receives the tip end portions 404 of the movable terminal 400 abutting against it. When the movable terminals 400 are retracted as shown, the actuator 410 moves forward and the locking surface 411 abuts against the tip end portions 404 of the movable terminals 400, forcing them down into the slits 240 against their elasticity.

The actuator 410 is connected to the levers 250 (FIG. 29) protrusively provided on the opposite sides of the connector unit 230. When the levers 250 are pressed, the actuator 410 moves in the direction away from the movable terminals 400 against the force of the press spring 420, and consequently, the locking surface 411 of the actuator 410 moves away from the tip end portions 404 of the movable terminals 400, removing pressure applied thereto. Accordingly, the movable terminals 400 outwardly project from the slits 240 of the connector unit 230 due to their elasticity and thus, come into contact with fixed terminals 320 of the external equipment 300.

FIG. 32 shows the underside of the external equipment 300 which is connected to the station 200. On the underside of the external equipment 330, there are provided a pair of grooves 310 for receiving the positioning rails 212 of the afore-mentioned case 210 and a pair of protrusions 321 which strike and press the levers 250 into the connector unit 230 when the connector unit 230 is moved. Further, there are two rows of staggered fixed terminals 320 at positions where they are aligned with the slits of the station 200 when the external equipment 300 is mounted thereon.

The external equipment 300 is mounted on the station 200 by first, aligning the underside of the former with the mounting recess 211 of the latter and then, sliding the former onto the latter so that the positioning rails 212 are fitted into the grooves 310.

After this, the electrical connection between the station 200 and the external equipment 300 is established by sliding the coupling plate 220 through manipulation of the operating lever 217 to move the connector unit 230 on the coupling plate 220. When the connector unit 230 is moved, the levers 250 of the connector unit 230 abut against the protrusions 321 of the external equipment 300 held in the recess 211 and the levers 250 are pressed into the connector unit 230, allowing the movable terminals 400 to jut out from the slits 240. In this instance, the slits 240 are each aligned with one of the fixed terminals 320 of the external equipment 300 and the movable terminals 400 come into elastic contact with the fixed terminals 320, establishing electrical connections therebetween.

That is, the connector unit 230 cooperates with the protrusions 321 of the external equipment 300 to project out the movable terminals 400 from the slits 240; therefore, when the external equipment 300 is not mounted in the recess 211, the movable terminals 400 are held in their retracted positions and hence are protected from destruction.

Thus, even if the operating lever 217 is inadvertently actuated when the external equipment 300 is not mounted on the station 200, the movable terminals 400 will not be exposed to the outside. This precludes the possibility of the movable terminals 400 being shorted or deformed or internal circuits being broken down as referred to previously.

Because of its structure that the connector unit 230 is held in the mounting recess 211 at all times, the above-described conventional connecting apparatus inevitably limits the direction of placement of the external equipment 300 in the recess 211, and hence it has the defect of difficulty in mounting the external equipment 300. Furthermore, since the direction of placement needs to be taken into account, the degree of freedom in designing the case 210 is low.

Additionally, upon each actuation of the operating lever 217, the movable terminals 400 and the link plate 216, the coupling plate 220 and other parts for displacing the movable terminals 400 are moved or driven, and if the operating lever 217 is repeatedly actuated by a child, for instance, these parts become short-lived due to the friction between them or fatigue from deformation.

FIG. 33 shows an example of another connecting apparatus for connecting a station 500 as the connecting apparatus to a portable video camera 520. The video camera 520 is mounted in a recess 511 of the case 510 of the station 500 and is electrically connected via the station 500 to the TV receiver 130. The case 510 of the station 500 has a connector unit 540 with contact portions of the movable terminals projecting outwardly therefrom. On the other hand, the video camera 520 has on its underside, an output connector 550 provided with fixed terminals for contact with the movable terminals of the connector unit 540.

To mount the external equipment 520 on the connecting apparatus of such a construction with the output connector 550 held opposite the connector unit 540, it is necessary to fit the external equipment 520 into the recess 511 diagonally from behind the case 510 while pressing the front of the external equipment 520 against the front wall 511*a* of the recess 511 as shown in FIG. 34. That is, an inward flange protrusively provided on the upper marginal portion of the front wall 511*a* is engaged with a groove 521 cut in the front of the external equipment 520 and a positioning protrusion 513 on the bottom 511*b* of the recess 511 is engaged with a groove 522 cut in the underside of the external equipment 520. Thus, the external equipment 520 is positioned in the recess 511. To prevent the external equipment 520 from being displaced backward on the case 510, a positioning pin 514 is projected out by a lever (not shown) from the bottom 511*b* of the recess 511 so that it is received in a hole made in the underside of the external equipment 520.

With this conventional connecting apparatus, the external equipment 520 is fitted into the recess 511 diagonally from behind so that it is placed at the corresponding engaging position in the connecting apparatus 500. Since the engaging position in the connecting apparatus 500 differs with models of external equipment, however, each model must be inserted into the recess 511 from a particular direction. Accordingly, some experience is required to place the external equipment 520 on the connecting apparatus 500 and it is hard for a person unfamiliar with the manipulation of this kind of equipment to mount it in position.

To ensure elastic contact between movable terminals of the connector unit 540 and fixed terminals of the output connector 550 for electric connections, the flange 512 is engaged with the groove 521 to firmly hold the external equipment 520 on the bottom of the recess 511. Because of this engaging structure, however, the external equipment 520 must be mounted on the case 510 from behind and the recess 511 needs to be larger than the outside shape of the external equipment 520, as shown in FIG. 33, to avoid interference therewith during its mounting operation. Hence, the case 510 is inevitably bulky, having a length L as clearance between the case 510 and the external equipments indicated in FIG. 33. This clearance incurs the possibility of the external equipment 520 being shifted in the recess 511; therefore, positioning means such as the positioning pin 514 and the positioning hole 523 are required.

To firmly hold the external equipment 520 on the case 510, it is also known a method which an inverted L-shaped hook protrusively provided on the bottom of the case 510 is engaged with a recess made in the underside of the external equipment 520. Also with this method, however, the external equipment 520 needs to be moved horizontally in the recess 511 for engagement with the inverted L-shaped hook, and during the mounting operation, the underside of the external equipment 520 might be damaged by the inverted L-shaped hook, whereas the hook may sometimes be broken by the external equipment 520.

SUMMARY OF THE INVENTION

It is therefore an object of the present invention to provide a connecting apparatus which holds the connector unit in its retracted position in the absence of external equipment, prevents the movable terminals from projecting out even by an inadvertent actuation of the operating lever and ensures the longevity of parts regardless of the indiscriminate actuation of the operating lever.

Another object of the present invention is to provide a connecting apparatus which has a mounting recess shaped to snugly receive external equipment and firmly hold it in place on the bottom of the recess.

Another object of the present invention is to provide a connecting apparatus which permits easy actuation of the connector unit.

Another object of the present invention is to provide a connecting apparatus which ensures mounting thereon of external equipment in a correct direction, permits downsizing of the case body and eliminates the necessity of using extra positioning means.

Another object of the present invention is to provide a connecting apparatus which precludes the possibilities of external equipment being damaged by a hook for engagement therewith and the hook being broken by the external equipment.

Still another object of the present invention is to provide a connecting apparatus which ensures tight locking of external equipment in place.

The present invention is directed to a connecting apparatus which includes a case body for detachably mounting external equipment in its mounting recess, a connector unit to be electrically connected to the connector of the external equipment, and an operating mechanism which, engages directly or indirectly with the connector unit and in which when the external equipment is placed in the mounting recess, the operating mechanism is actuated to connect the connector unit to the connector of the external equipment.

According to an aspect of the present invention, the operating mechanism includes: an operating lever projecting out from the case body; a slider body formed integrally with the operating lever and horizontally guided along a slider guide groove formed in the case body; an engaging pin composed of an engaging shaft loosely inserted in a through hole bored through the slider body and a slide flange formed integrally with the engaging shaft at the base end thereof; a compression spring disposed between the slide flange and the slider body, for energizing the slide flange toward the inside of the slide guide groove; a first stage portion provided in the interior surface of the slide guide groove, for horizontally guiding the slide flange; a second stage portion provided in the interior surface of the slide guide groove in parallel to the first stage portion, for horizontally guiding the slide flange at a height different from the position of guiding by the first stage portion; a sensor pin energized to project outwardly into the mounting recess through the case body; a switching plate operatively associated with the sensor pin to vertically move at one end of the slide guide groove in such a manner as to be flush with the first stage portion when the sensor pin projects outwardly into the mounting recess and with the second stage portion when the sensor pin is retracted into the case body; and a spring for energizing the slider body toward the above-mentioned one end of the slide guide groove so that the slide flange slides onto the switching plate. When the sensor pin is pressed into the case body by external equipment mounted in the mounting recess, the engaging pin energized by the compression spring is guided while being pressed against the second stage portion and the engaging shaft projects outwardly from the slider body and into direct or indirect engagement with the connector unit. When the sensor pin projects outwardly into the mounting recess, the engaging pin energized by the compression spring is guided while being pressed against the first stage portion and the engaging shaft retracts into the slider body.

With the structure described above, even if the operating lever is inadvertently actuated when no external equipment is mounted in the mounting recess, no driving force is transmitted to the connector unit and the movable terminals will not be exposed to the outside. Hence, there is no possibility of accidental shorting of the movable terminals by a conductive foreign substance, of inadvertent damage to internal circuit, or deformation of the movable terminals by touching of a finger charged with static electricity.

Further, even if the slider body is moved by indiscriminate inadvertent actuation of the operating lever, no force is transmitted to the link plate side and associated parts at the connector unit side will neither be worn out nor fatigued by deformation. Hence, the connecting apparatus is durable.

According to another aspect of the present invention, the connector unit is connected to the intermediate portion of the link pivotally secured at one end to the case body and the engaging shaft projecting outwardly from the slider body is engaged with an elongated hole made in the free end portion of the link plate so that the connector unit is moved, by the actuation of the operating lever, from its retracted position in the case body to a position for connection to the external equipment.

With the above structure, when no external equipment is mounted in the mounting recess, the engaging shaft of the engaging pin remains retracted in the slider body and out of engagement with the link plate. Accordingly, even if the slider body is moved by actuating the operating lever, no driving force is transmitted to the link plate and the connector unit and their associated parts will not be worn out, nor will they be fatigued by deformation. When no external equipment is mounted in the mounting recess, the connector unit remains retracted in the case body, and hence it will not encumber the mounting of external equipment.

When external equipment is mounted in the mounting recess, the engaging shaft of the engaging pin projects outwardly from the slider body and engages with the link plate. Then, upon actuation of the operating lever, the connector unit is driven through the link plate from its retracted position to the position for connection to the external equipment, where it is connected to the connector of the external equipment. In this instance, since the manipulation of the operating lever moves the connector unit through utilization of leverage and is not acted upon by a spring for holding the movable terminals in the connector unit, the operating lever can be actuated with ease.

According to another aspect of the present invention, the connector unit is energized by a return spring to moved to its retracted position, and a locking mechanism is provided which locks the link plate at the position where the link plate has been turned to bring the connector unit to a position for its connection against the return spring.

With the above structure, when no external equipment is mounted in the mounting recess, the slider body formed as a unitary structure with the operating lever is out of engagement with the link plate and, therefore, the movement of the lever by its inadvertent actuation will not be limited by the locking mechanism. Hence, even if the operating lever is repeatedly moved back and forth by indiscriminate actuation, there is no fear of the locking mechanism being broken.

When external equipment is mounted in the mounting recess, the link plate is turned by the movement of the operating lever, and hence it can be turned fully until the connector unit reaches the position for its connection to the connector of the external equipment. Then, the link plate is locked at its fully-turned position and, therefore, even if the operating lever is released from actuation, the connection to the external equipment can be maintained, allowing a user to manipulate the connecting apparatus with both his hands.

According to another aspect of the present invention, the locking mechanism includes: a locking block guided horizontally in a lock guide groove formed in the case body; a pin protrusively provided on the locking block for engagement with the link plate; and a locking plate for locking the locking block at the link plate fully-turned position. In a guide case, disposed along the back of the mounting recess, between the mounting recess and the link plate, a slide guide groove is provided beside a lock guide groove, through which the engaging shaft projecting outwardly from the slider body and the pin protrusively provided on the locking block are respectively engaged with the link plate.

With the above structure, the mechanism for switching between engagement and disengagement of the link plate and the operating lever and the locking mechanism for locking the link plate can be formed by parts which are housed as units in the guide case, and hence these mechanisms can easily be assembled with the case body.

According to another aspect of the present invention, the connecting apparatus includes: a case body having hook receiving through holes extending from the mounting recess to the case body; an operating plate manually operated to slide along the underside of the case body below the hook receiving holes; locking hooks, each having a top end portion bent substantially at right angles towards the front into an L-shape and pivotally secured at its base end to the operating plate at such a position where the L-shaped top end portion partly enters one of the hook receiving holes as the operating plate slides; twisted coiled springs mounted on the operating plate, for energizing the locking hooks to turn from the front to the back; and stoppers formed integrally with the operating plate, for limiting the turning movement of the locking hooks when they stand up perpendicularly to the direction of sliding movement of the operating plate. The external equipment, mounted in the mounting recess, is positioned by sliding the operating plate from its initial position where the back of each locking hook abuts against the underside of the case body to a position where each locking hook is standing up in the hook is receiving holes engages with an engaging groove of the external equipment.

With the above structure, when the operating plate is at its initial position, the back of each locking hook abuts against the underside of the case body, so that the locking hook does not project outwardly into the mounting recess. Accordingly, when the external equipment is mounted into the mounting recess, the external equipment will not be damaged by the locking hooks and the mounting recess will not be broken by the external equipment.

Upon sliding the operating plate, the locking hooks partly enter the hook receiving holes and by the action of the twisted coiled springs, they are turned up into abutment with the stoppers in the hook receiving holes. By the sliding movement of the operating plate, the locking hooks go further into the hook receiving holes while standing up and finally come into engagement with engaging holes of the external equipment. Since the external equipment need not be moved in the mounting recess for engagement with the locking hooks, the mounting recess can be made small so as to snugly receive the external equipment and the case body need not be made large.

When the operating plate slides to the locking position, the locking hooks engage the engaging holes and are firmly held in the mounting recess.

According to another aspect of the present invention, the connecting apparatus includes: a case body having hook receiving through holes extending from the mounting recess to the case body; an operating plate manually operated to slide along the underside of the case body below the hook receiving holes; locking hooks, each having a top end portion bent substantially at right angles towards the front into an L-shape and pivotally secured at a base end to the operating plate at such a position where the L-shaped top end portion partly enter one of the hook receiving hole as the operating plate slides; twisted coiled springs mounted on the operating plate, for energizing the locking hooks to turn from the front to the back; stoppers formed integrally with the operating plate, for limiting the turning movement of the locking hooks when they stand up perpendicularly to the direction of sliding movement of the operating plate; a coupling plate having an upwardly opening guide recess for slidably guiding therein the operating plate; coiled springs stretched between the coupling plate and the operating plate, for energizing the operating plate into abutment with a slide stopper planted upright on the coupling plate; and a coupling plate operating mechanism for sliding the coupling plate in parallel with the direction of sliding movement of the operating plate by means of the coiled springs. After sliding the operating plate, by the sliding movement of the coupling plate, from its initial position where the back of each locking hook abuts against the underside of the case body to a position where the locking hook standing up in the hook receiving hole engages with the corresponding engaging groove of the external equipment, the coupling plate is further slid to actuate the coiled springs to energize the locking hooks into engagement with the engaging holes, thereby positioning the external equipment placed in the mounting recess.

With the above structure, prior to sliding the coupling plate, the operating plate is held in abutment with the slide stopper under the action of the coiled springs and is positioned at its initial position. When the operating plate is at the initial position, the back of each locking hook abuts against the underside of the case body, and hence the locking hook does not project outwardly into the mounting recess. Accordingly, during the mounting of the external equipment in the mounting recess, the locking hooks will not cause damage to the external equipment nor will the external equipment cause damage to the locking hooks.

Upon sliding the coupling plate, the operating plate slides with the coupling plate while being held in abutment with the slide stopper by the coiled spring. When the locking hooks partly enter the hook receiving holes by the sliding movement of the coupling plate, they are turned up into abutment with the stoppers in the hook receiving holes by the action of the twisted coiled springs. When the operating plate further slides in association with the sliding movement of the coupling plate, the locking hooks go further into the hook receiving holes while standing up and finally come into engagement with engaging holes of the external equipment. Since the external equipment need not be moved horizontally in the mounting recess for engagement with the locking hooks, the mounting recess can be made small so as to snugly receive the external equipment and the case body need not be made large. Moreover, the external equipment needs only to be placed into the mounting recess, and hence it can easily be mounted on the connecting apparatus.

When the operating plate slides to the locking position, the locking hooks engage the engaging holes. Thus, firmly holding them in the mounting recess.

After further sliding the coupling plate upon bringing the operating plate to the locking position, the operating plate stands still there, but the coiled springs are compressed by the sliding movement of the coupling plate. Consequently, the locking hooks are energized by the coiled springs into the locking holes of the external equipment, ensuring locking of the external equipment. Besides, the stroke of the coupling need not be strictly controlled in accordance with the locking position of the operating plate and can also be used for operating other mechanisms.

According to still another aspect of the present invention, the connector unit is secured to the case body so that it is operatively associated with the coupling plate to move back and forth between its retracted position in the case body and the position where it is connected to the connector of external equipment. When the connector unit is moved, by the sliding movement of the coupling plate, from the retracted position to the position for connection to the external equipment, the operating plate slides from its initial position to the locking position, and after stopping of the operating plate at the locking position, the coiled springs are compressed by the sliding movement of the coupling plate.

With this structure, the coupling plate operating mechanism can also be used as a mechanism for connecting the connector unit to the connector of the external equipment.

When no external equipment is placed in the mounting recess, the connector unit stays at its retracted position and the movable terminals are not exposed to the outside, and hence they will not be shorted or deformed by a foreign object.

When the connector unit is brought from the retracted position to the position for connection by sliding the coupling plate, the movable terminals come into contact with fixed terminals of the external equipment and the locking hooks stand up and engage with the engaging holes of the external equipment. Hence, the coupling plate for driving the connector unit can also be used as a coupling plate for moving the locking hooks.

BRIEF DESCRIPTION OF THE DRAWINGS

FIG. 5 is a longitudinal-sectional view of a guide case 13 taken along a slide guide groove, with no external equipment mounted;

FIG. 6 is a longitudinal-sectional view of the guide case 13, with an operating lever 11 actuated in the state of FIG. 5;

DESCRIPTION OF THE PREFERRED EMBODIMENTS

Figure 1:
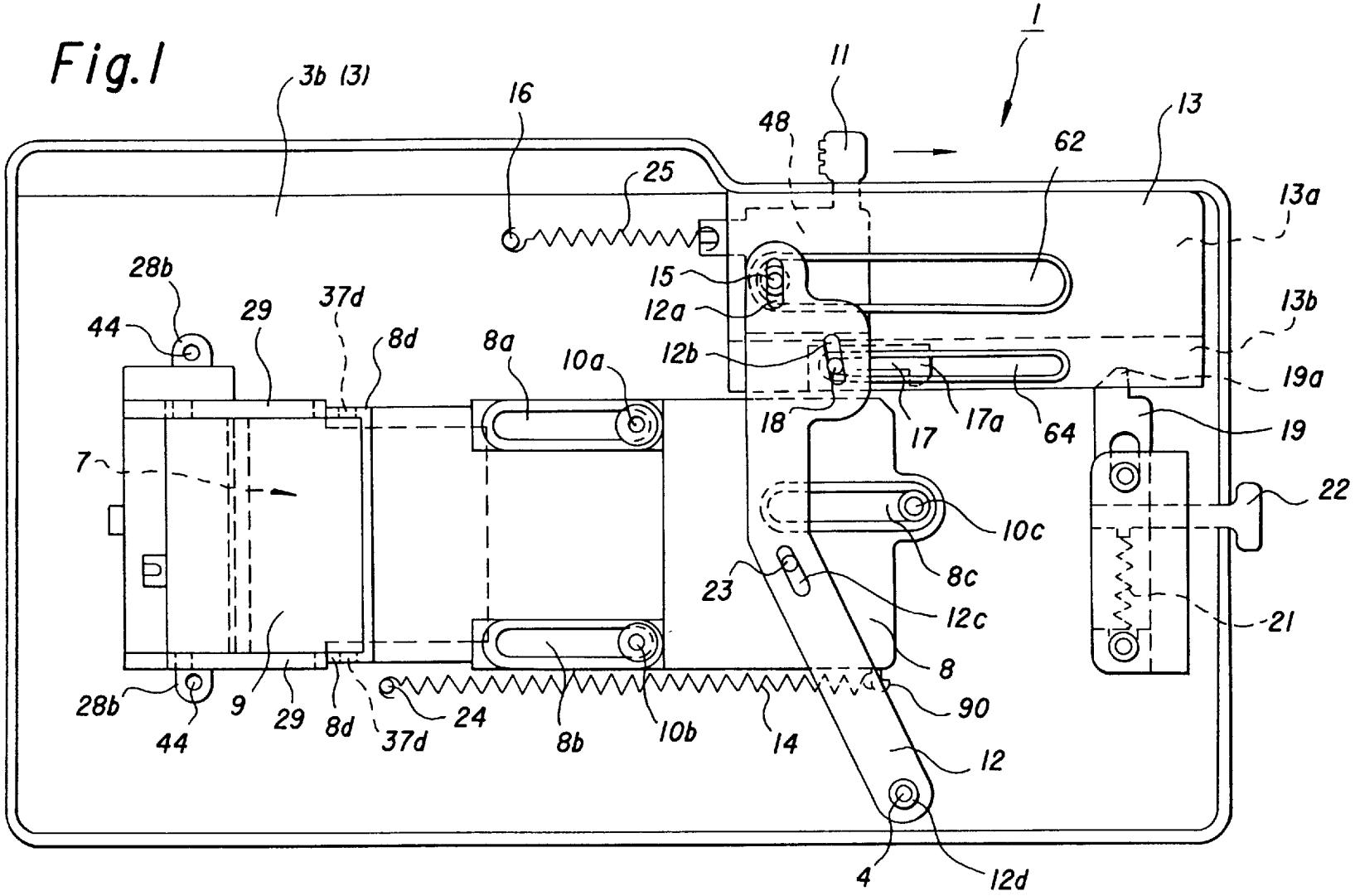
FIG. 1 is a bottom view, partly cut away, of the connecting apparatus according to an embodiment of the present invention, with a connector unit 9 held at its retracted position.

FIGS. 1 through 27 illustrate an embodiment of the connecting apparatus of the present invention which is applied as a station 1 for connection with a video camera. The station 1 is provided with a case body 3 for detachably mounting thereon external equipment 2, and a connector unit 9 which is moved in the case body 3 in association with a coupling plate 8.

Figure 27:
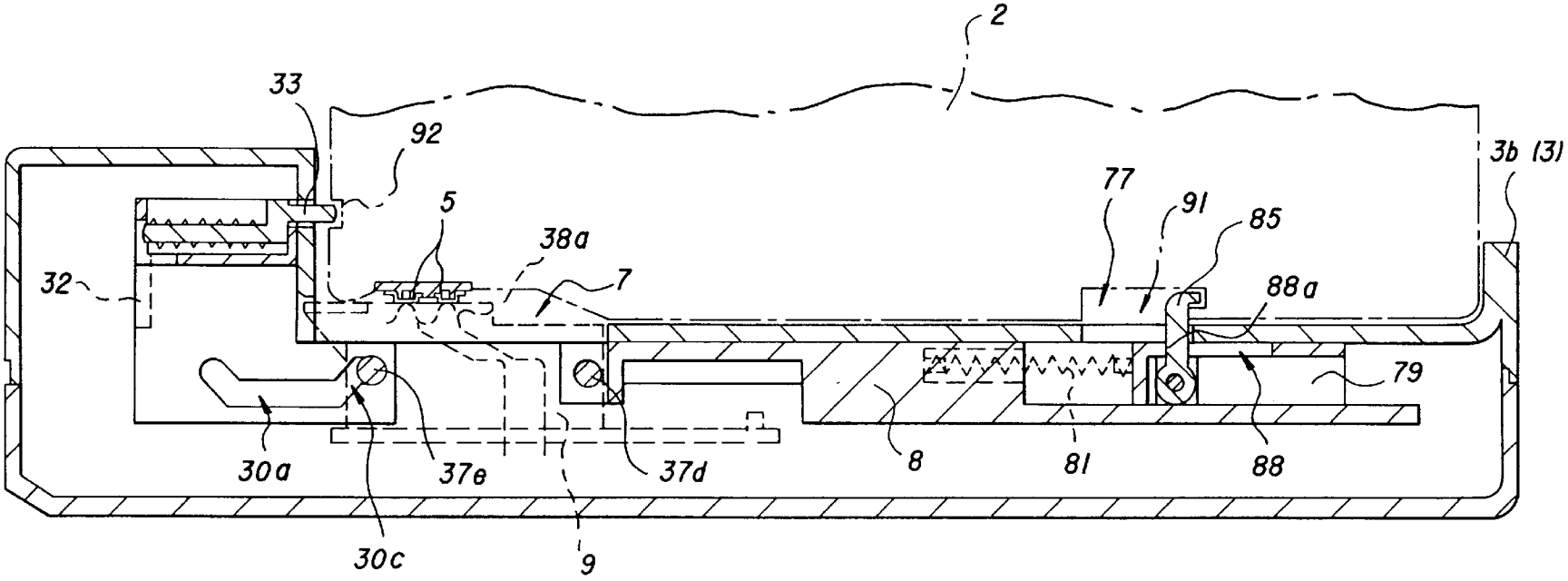
FIG. 27 is a longitudinal-sectional view of the connecting apparatus 1 with the connector unit 9 held at its connecting position and the locking hooks 85 energized by coiled springs 81 at their locking position.
Figure 28:
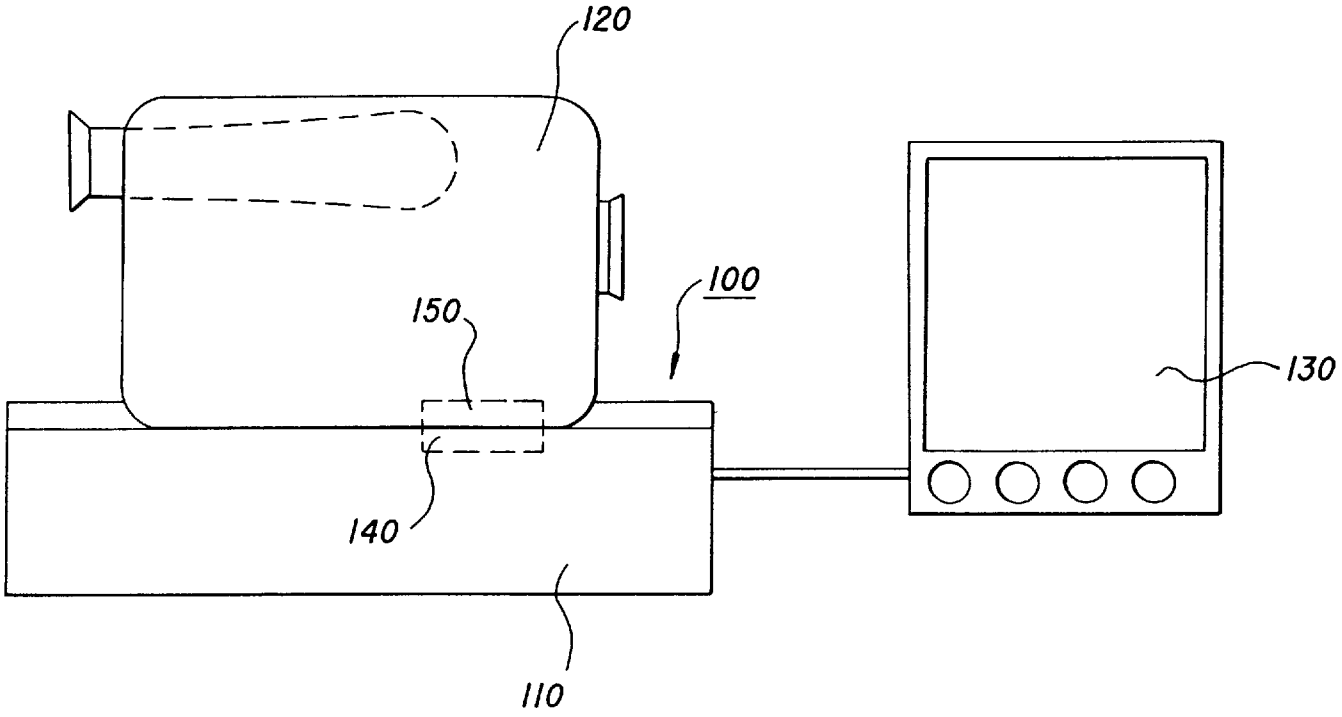
Fig.28 PRIOR ART
FIG. 28 is a diagram showing the connection between external equipment 120 and a connecting apparatus 100.
Figure 29:
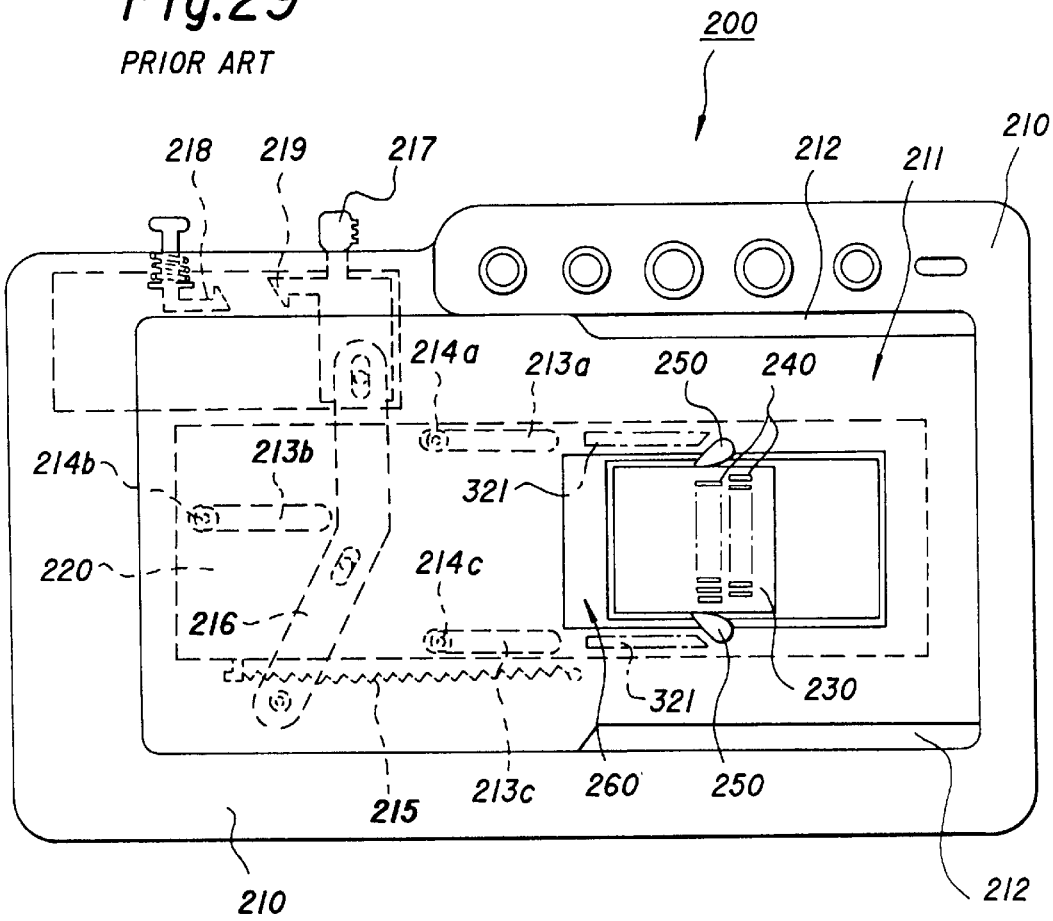
Fig.29 PRIOR ART
FIG. 29 is a plan view of a conventional connecting apparatus 200.
Figure 30:
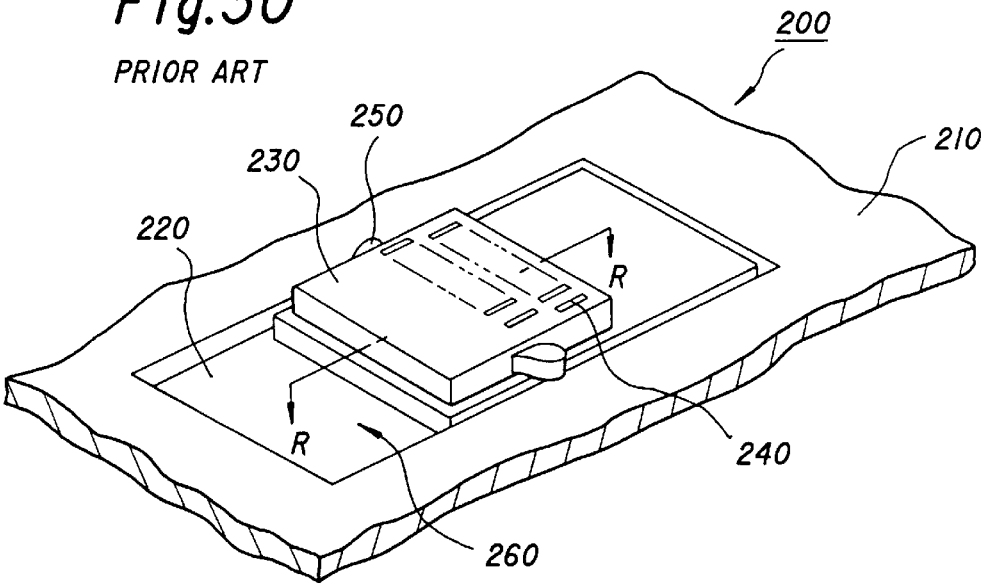
Fig.30 PRIOR ART
FIG. 30 is a partly cut-away perspective view showing a connecting part of the conventional apparatus 200.
Figure 31:
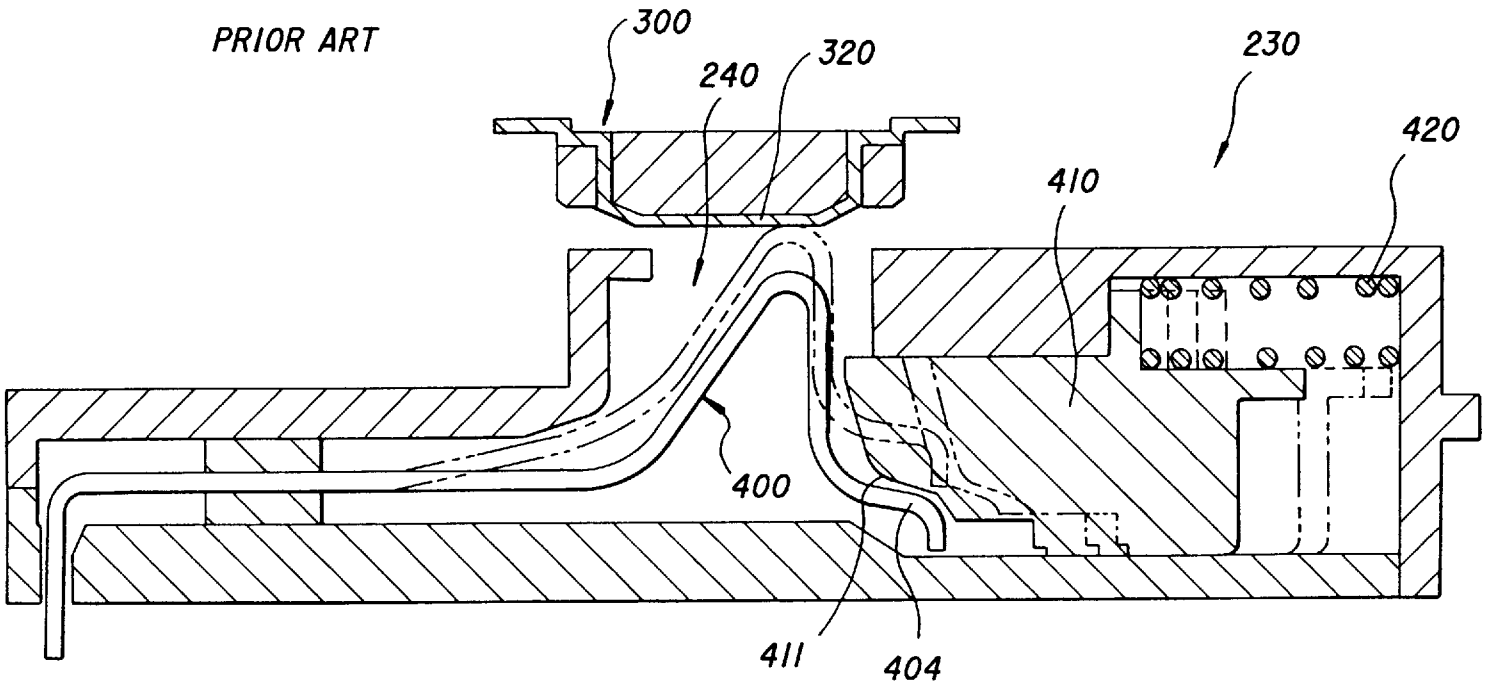
Fig.31 PRIOR ART
FIG. 31 is a longitudinal-sectional view taken along the line R—R in FIG. 30, showing a connector unit 230 of the conventional apparatus 200.
Figure 32:
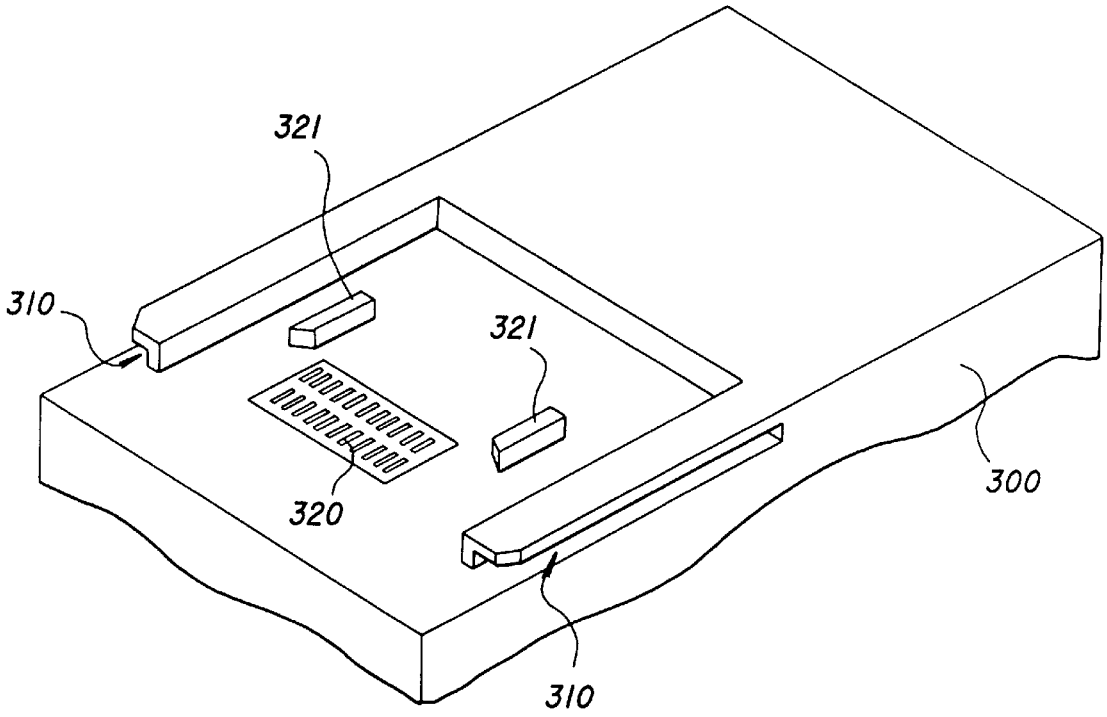
Fig.32 PRIOR ART
FIG. 32 is a perspective view showing the underside of conventional external equipment 300.
Figure 33:
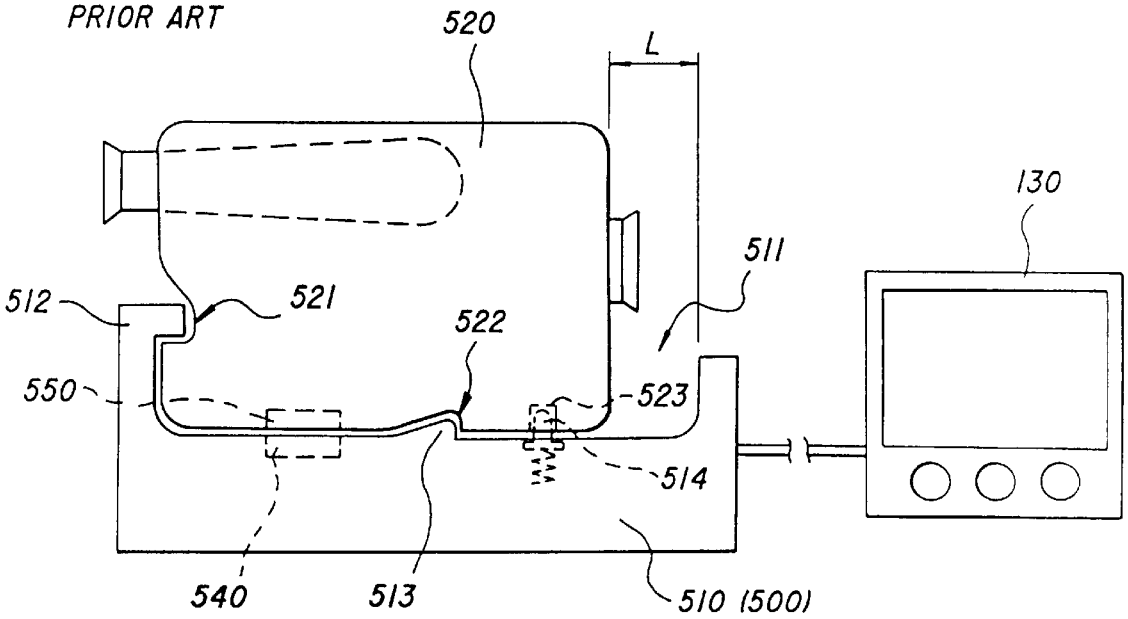
Fig.33 PRIOR ART
FIG. 33 is a schematic diagram of another conventional connecting apparatus with external equipment 520 mounted thereon.
Figure 34:
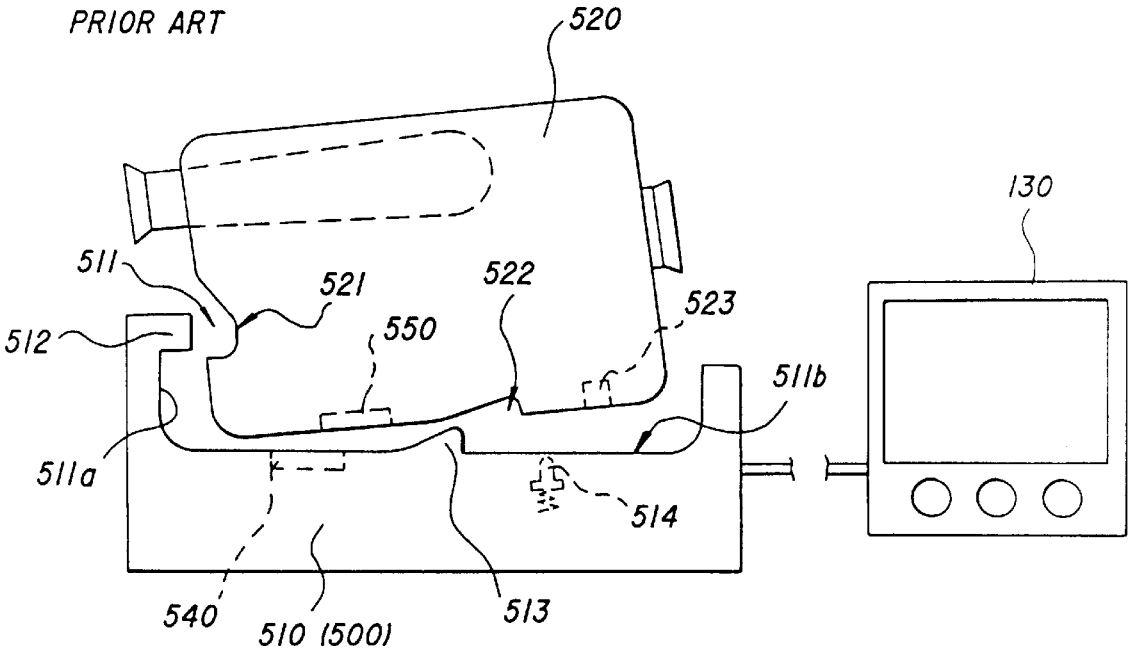
Fig.34 PRIOR ART
FIG. 34 is a schematic diagram showing how to mount the external equipment 520 into a mounting recess 511 of the conventional connecting apparatus 500.

The external equipment 2 is the video camera 120 shown in FIG. 28 or 520 in FIG. 33, or some other electronic device. On the underside of the external equipment 2, there is mounted a connector having two rows of staggered flat fixed terminals 5 as shown in FIGS. 24 to 27.

Figure 19:
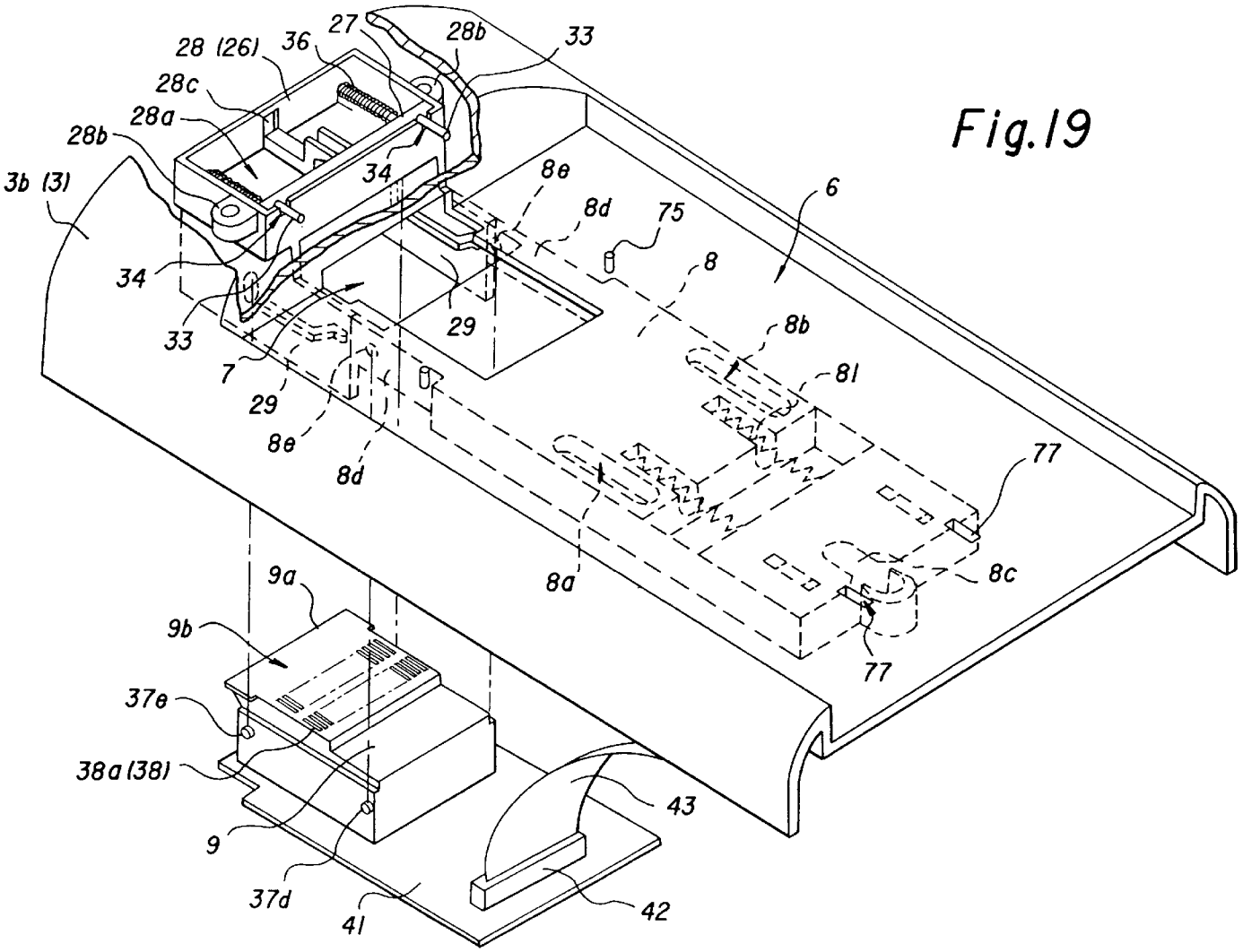
FIG. 19 is a partly exploded perspective view of the connecting apparatus 1.

The case body 3 depicted in FIG. 19 has a mounting recess 6 in a top surface thereof. The mounting recess 6 is about the same shape as the outside shape of the external equipment 2 so that the external equipment 2 is mounted on the case body 3 without any undue play between them. The mounting recess 6 has positioning bosses 75 planted upward thereon at several positions and two hook receiving holes 77 made therein lengthwise of the recess 6 for receiving locking hooks 85 described later on. When the external equipment 2 placed in the recess 6 is positioned by the positioning bosses 75 and the locking hooks 85, the fixed terminals 5 of the external equipment 2 are located above an opening 7 formed in the forward end of the recess 6, through which movable contacts 38 of the connector unit 9 make contact with the fixed terminals of the external equipment 2 as described later on.

The case body 3 is composed of bottom and top case halves 3*a* and 3*b* and is formed hollow in its entirety, and the coupling plate 8 and the connector unit 9 are slidably secured to the case body 3 inside thereof.

As shown in FIG. 1, the coupling plate 8 has three elongated holes 8*a*, 8*b* and 8*c* extending lengthwise thereof along both sides and at the rear thereof, and three guide pins 10*a*, 10*b* and 10*c*, thread-mounted on the underside of the top case half 3*b*, are loosely inserted in the elongated holes 8*a*, 8*b* and 8*c*, respectively, so that the coupling plate 8 is slidable along the underside of the top case half 3*b* in the front-to-back direction (to right and left in FIG. 1).

Extending from opposite marginal portions of the front end of the coupling plate 8 are a pair of arms, which have through holes 8*e* (FIG. 19) and rotary shafts 37*d* protruding from both side surfaces of the connector unit 9 rearward thereof, are loosely inserted in the holes 8*e* of the arms 8*d* so that the rear end portion of the connector unit 9 is pivotally secured to the coupling plate 8.

Figure 13:
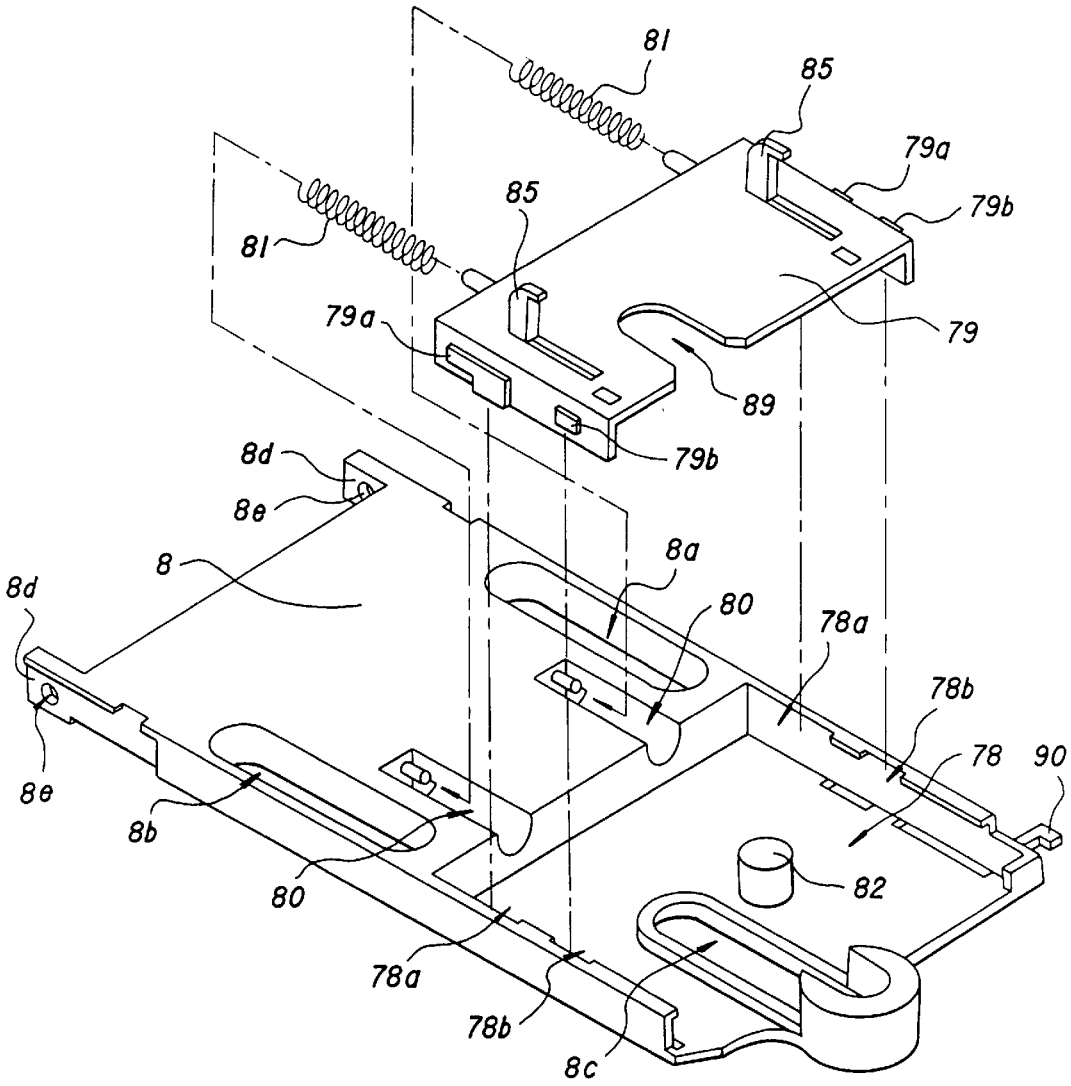
FIG. 13 is an exploded perspective view showing the assembling of a coupling plate 8 and an operating plate 79.
Figure 14:
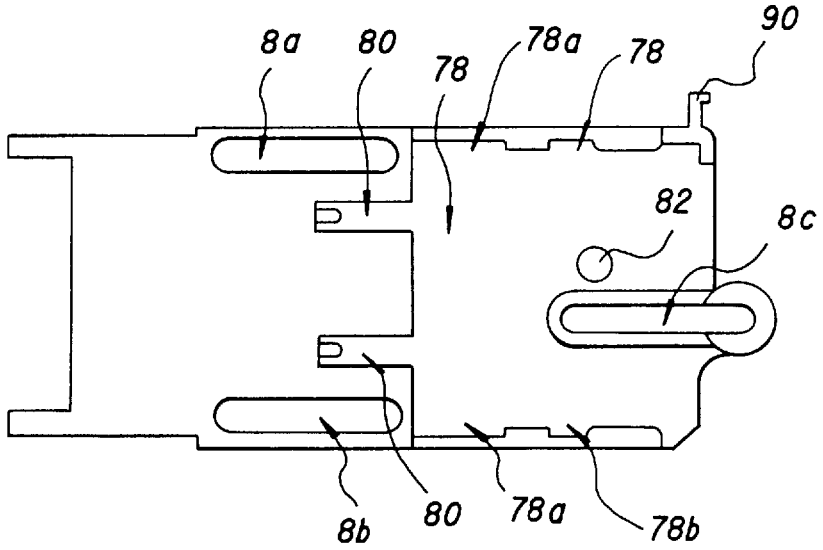
FIG. 14 is a plan view of the coupling plate.
Figure 15:
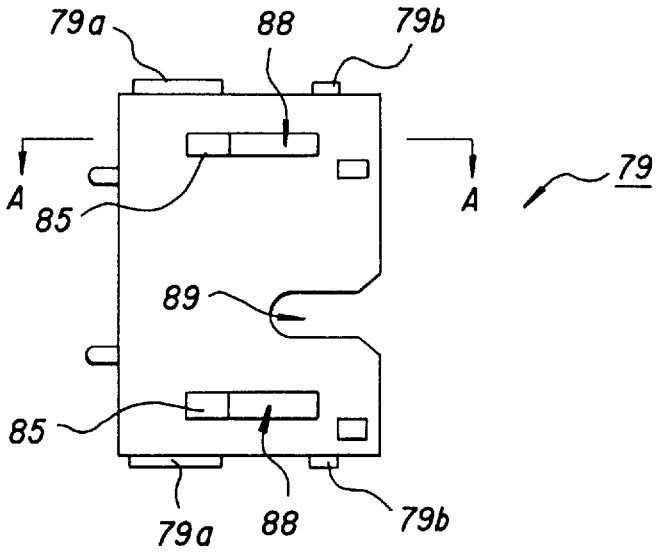
FIG. 15 is a plan view of the operating plate 79.
Figure 16:
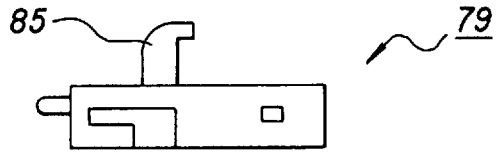
FIG. 16 is a side view of the operating plate 79.

As depicted in FIGS. 13 and 14, the backward portion of the coupling plate 8 forms an upwardly opening guide recess 78, wherein an operating plate 79 is slid in the front-to-back direction. The operating plate 79 has first and second pairs of opposed guide pieces 79*a* and 79*b* protrusively provided on both side surfaces and is received in the guide recess 78 with the guide pieces 79*a* and 79*b* inserted in first and second pairs of opposed guide grooves 78*a* and 78*b* cut in both upper marginal portions of the guide recess 78, respectively.

In grooves 80 cut in the coupling plate 8, coiled springs 81 are housed. The coiled spring 81 are compressed between the front of the operating plate 79 and the coupling plate 8 so as to energize the operating plate 79 backwardly. The operating plate 79 is open downward and rearward so that no external force is applied to the operating plate 79. The interior surface 79*c* of the front wall of the operating plate 79 abuts against a slide stopper 82 plated on the bottom of the guide recess 78 and stands still there.

Thus, as the coupling plate 78 slides along the underside of the case body 3, the operating plate 70, positioned in the guide recess 78, slides along the underside of the case body.

Figure 17:
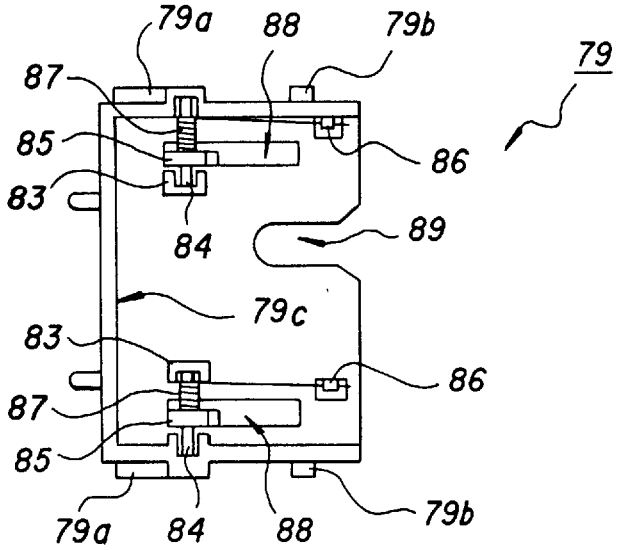
FIG. 17 is a bottom view of the operating plate 79.
Figure 18:
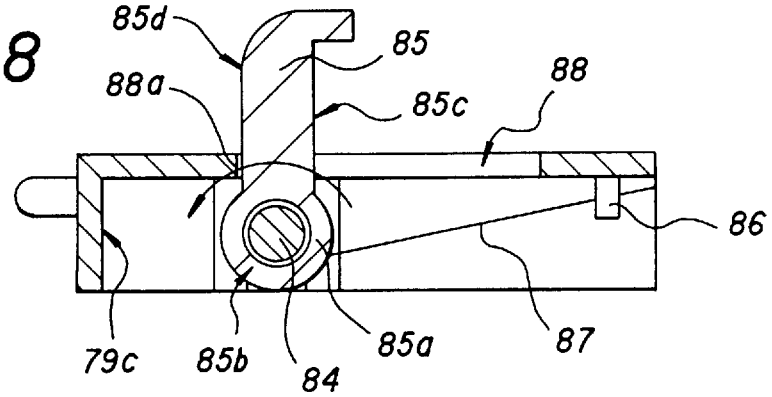
FIG. 18 is a longitudinal-sectional view of the operating plate 79 taken along the line A—A in FIG. 15.

As illustrated in FIG. 17, the operating plate 79 has a pair of bearings 83 projecting downwardly from the underside thereof and pivots 84 which are disposed between the bearings 83 and bearing holes made in the inner sides of the operating plate 79 opposite to the bearings 83, respectively. The pivots 85 are each loosely inserted in a hole 85*b* made in the base end portion 85*a* of one of the L-shaped locking hooks 85 to support it in such a manner as to allow its turning about the pivot 85.

The pivots 84 each have a twisted coiled spring 87 wound thereon, abutting at one end against the front 85*c* of one of the locking hooks 85 and retained at the other end by a spring bearing 86 protrusively provided on the underside of the operating plate 79. The locking hooks 85 are each energized by one of the coiled springs 87 to turn about its base end portion 85*a* in a direction from the front 85*c* to the back thereof (as indicated by the arrow in FIG. 18).

The operating plate 79 has a pair of slits 88, through which the locking hooks 85 outwardly project upwardly thereof. The forward inner wall 88*a* of each slit 88, against which the back of the locking hook 85 abuts, serves as a stopper 88*a* which limits its further turning movement. At the position where it abuts against the stopper 88*a*, the locking hook 85 stands upright and outwardly projects upwardly through the slit 88.

Incidentally, the operating plate 79 has a clearance groove 89 cut thereinto from its rear end to avoid interference between the operating plate 79 and the guide pin 10*c* which move as the coupling plate slides as referred to previously.

On the other hand, the locking hooks 85 are disposed in the operating plate 79 so that they are aligned with the hook receiving holes 77 when the operating plate 79 slides along the underside of the case body 3. Hence, when the locking hooks 85 have moved to the position just under the hook receiving holes 77, they project out into the mounting recess 6 through the hook receiving holes 88.

Figure 3:
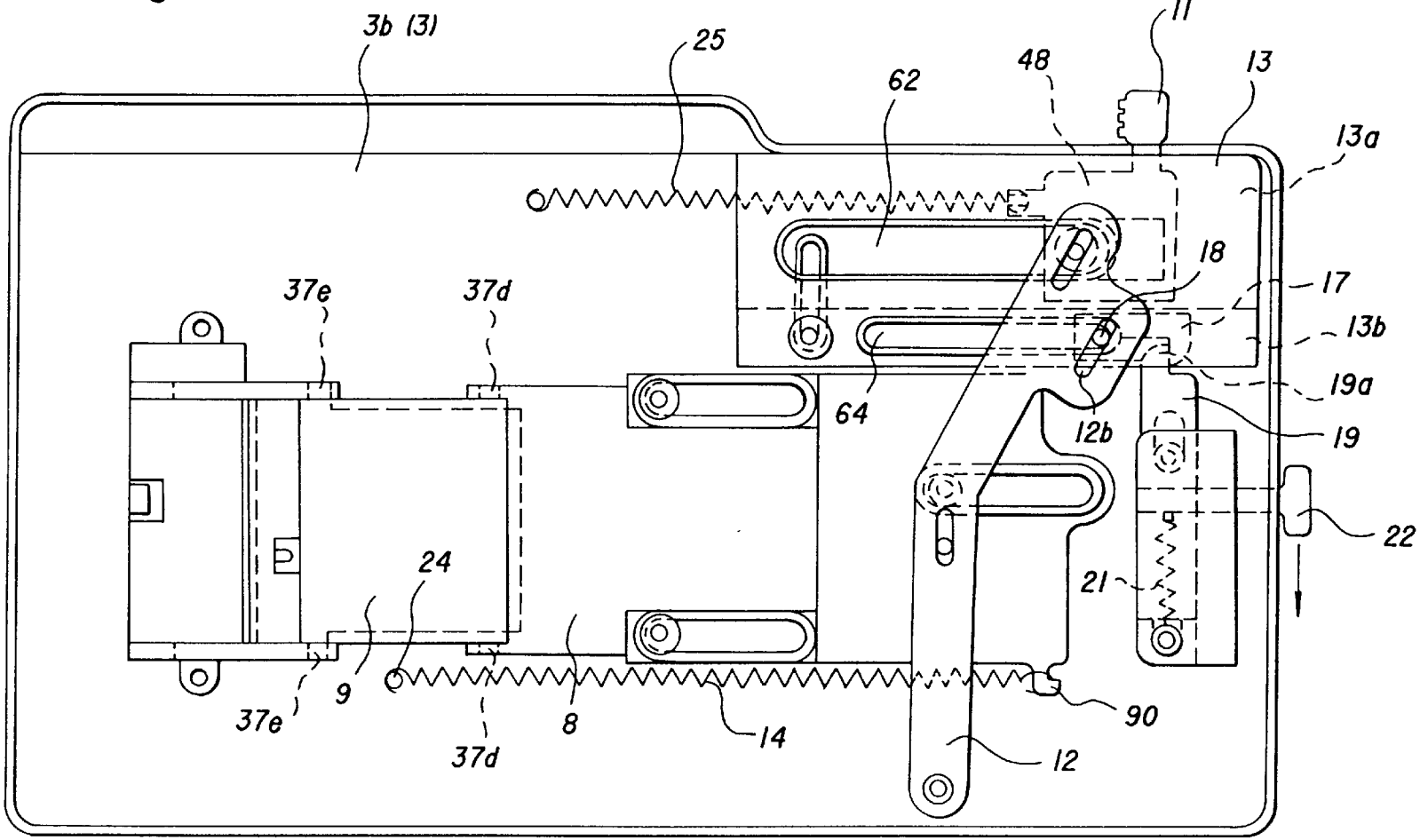
FIG. 3 is a bottom view, partly cut away, of the connecting apparatus with the connector unit 9 held at its connecting position.

As depicted in FIGS. 1 and 3, the coupling plate 8 is always energized forward (to the left-hand side in FIGS. 1 and 3) by a return spring 14 stretched between a spring bearing hook 90 formed at one side of the coupling plate 8 and a spring bearing 24 protrusively provided on the top case half 3*b*. The coupling plate 8 is slid backwardly by manually pushing the operating lever 11 backwardly against the return spring 14 as indicated by the arrow. The movement of the operating lever 11 is transmitted to the coupling plate 8 by the link plate 12 interposed therebetween.

The link plate 12 is pivotally secured at one end to the case body 3 by a pivot pin 4 inserted through a through hole 12*d* and threadably attached to the top case half 3*b*. The link plate has an elongated hole 12*c* bored therethrough at its intermediate portion, a pin planted on the coupling plate 8 being loosely inserted in the elongated hole 12*c*. The top end portion of the link plate 12 is turned by the movement of the operating lever 11. As the link plate 12 turns, the coupling plate 8 and the connector unit 9 are moved in parallel in the same direction. That is to say, in this embodiment, the coupling plate actuating mechanism for actuating the coupling plate 8 serves also as a connector unit operating mechanism.

Next, a description will be given, with reference to FIGS. 1, 5 and 10 through 12, of the above-mentioned actuating mechanism and a locking mechanism for locking the coupling plate 12. Reference numeral 13 denotes a box-shaped guide case composed of a guide case body 13*c* and an under cover 13*d* forming the bottom of the guide case body 13*c*. In the guide case 13, a slide guide chamber 13*a* for receiving a switching mechanism is provided beside a lock guide chamber 13*b* for receiving the locking mechanism. The guide case 13 is threadably attached to the case body 3 at such a position where a sensor pin 45 projects outwardly through a sensor pin receiving hole 46 between the back of the mounting recess 6 and the link plate 12.

Figure 11:
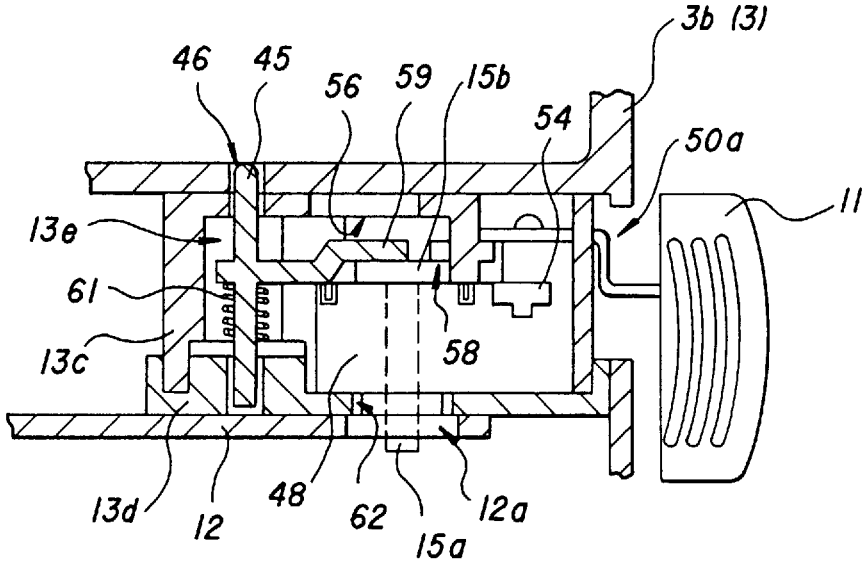
FIG. 11 is a cross-sectional view of the guide case 13 along the switching plate 59 in the state of FIG. 8.
Figure 12:
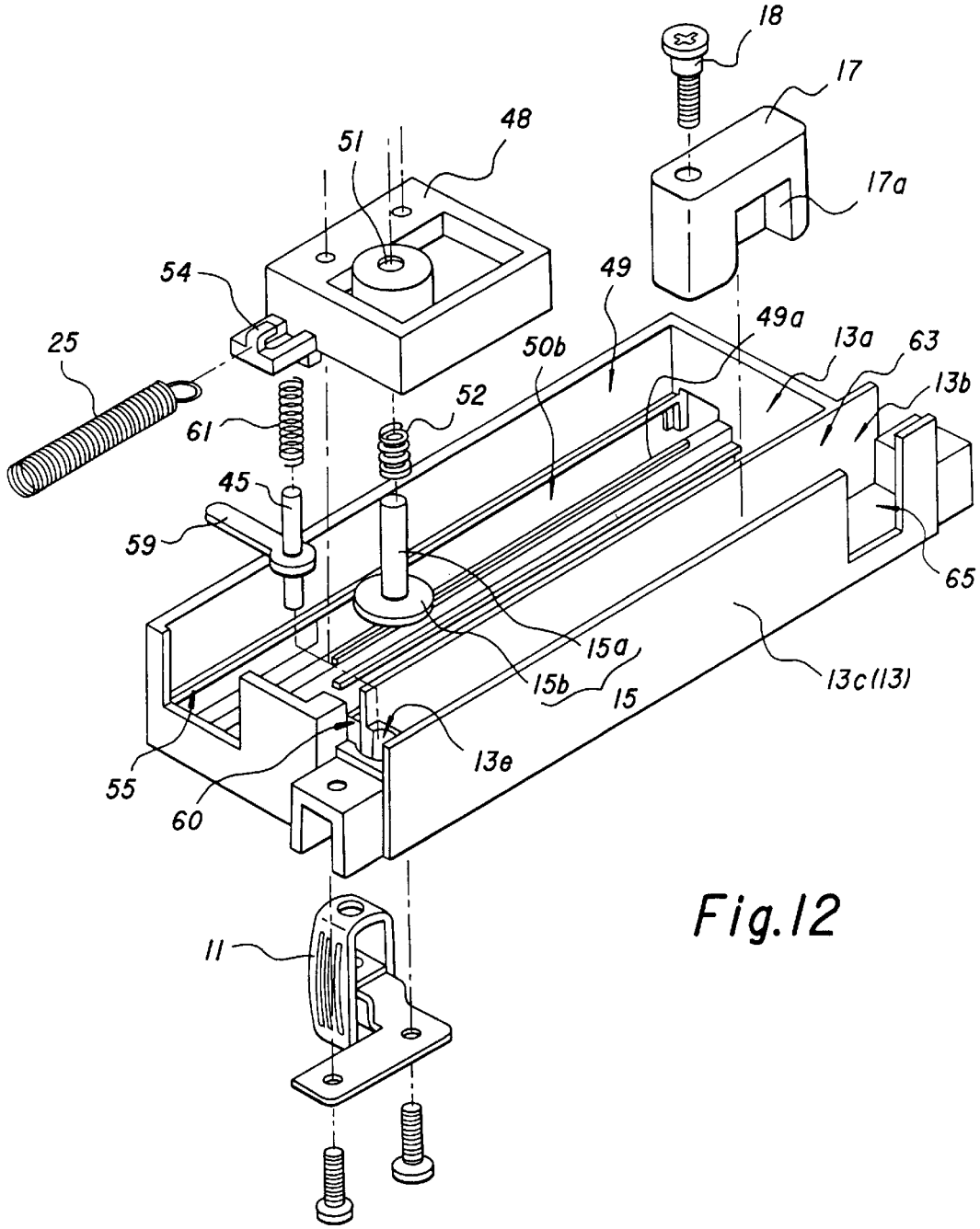
FIG. 12 is an exploded perspective view showing the principal part of the guide case 13.

As illustrated in FIG. 12, a slide guide groove 49 is formed in the slide guide chamber 13*a*. A slider body 48 is guided in the slide guide groove 49 by a slide rail 49*a* lengthwise thereof. To operate the slider body 48 from the outside of the case body 3, the operating lever 11 is secured to the slider body 48 by screws through a slit 50*a* made in one side of the case body 3 (see FIG. 11) and a slit 50*b* made in one side of the guide case 13.

The slider body 48 has a through hole 51 in which a shaft 15*a* of an engaging pin 15 is loosely inserted, and a compression spring 52 is disposed between a stepped portion (not shown) in the through hole 51 and a slide flange 15*b* formed integrally with the pin 15 at the base end thereof. Thus, the pin 15 is pushed by the spring 52 toward the inside of the slide guide groove (upward in FIG. 5). On the front of the slider body 48 (on the right-hand side in FIG. 5), there is protrusively provided a hook 54, from which a positioning spring 25 is stretched to a spring bearing lug 16 on the case body 3 through a window 55 of the guide case 13. The slider body 48 is pulled by the spring 25 toward the front end of the slide guide groove 49 by which the slide flange 15*b* of the pin 15 is slid onto a switching plate 59 described later on.

Figure 10:
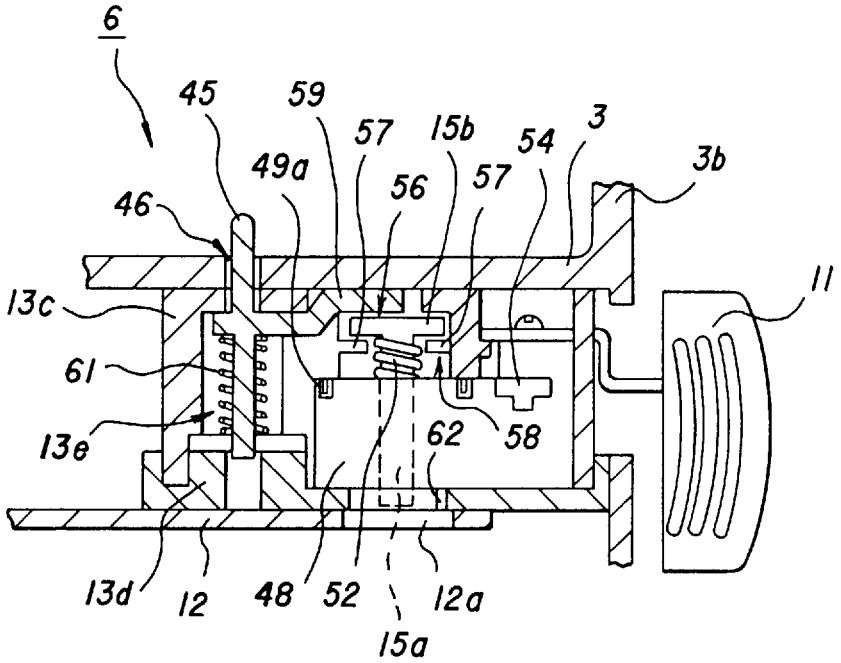
FIG. 10 is a cross-sectional view of the guide case 13 along a switching plate 59 in the state of FIG. 6.

As depicted in FIGS. 5 and 10, the inner top portion of the slide guide groove 49 forms a first stage portion 56 for horizontally guiding the slide flange 15*b*, and the slide guide groove 49 has slide ribs 57 protrusively provided on its inner side walls below its inner top and extending in parallel thereto. The portion below the guide ribs 57 forms a second stage 58 for horizontally guiding the slide flange 15*b*.

As shown in FIG. 12, there is defined in the guide case 13 forward of the slide guide chamber 13*a* and the lock guide chamber 13*b* a sensor pin housing chamber 13*e* in which to house a sensor pin 45 forming a sensor mechanism. The sensor pin 45 has a switching lever 59 horizontally affixed to its intermediate portion. The switching lever 59 projects outwardly into the front end portion of the slide guide groove 49 through a through hole 60 intercommunicating with the sensor pin housing chamber 13*e* and the slide guide groove 49. Between the base end portion of the switching lever 59 and the under cover 13*d* covering the sensor pin housing chamber 13*e*, there is disposed a spring 61 which energizes the sensor pin 45 upwardly (downwardly in FIG. 12) to outwardly project from its top end into the mounting recess 6 through a through hole 46.

As is evident from FIGS. 10 and 11, the switching lever 59, formed as a unitary structure with the sensor pin 45, moves up and down in the forward end portion of the slide guide groove 49 in such a manner that it is flush with the first stage portion 56 when the sensor pin projects outwardly into the mounting recess 6 and with the second stage portion 58 when the sensor pin 45 retracts into the case body 3. Hence, when the external equipment 2 is not placed in the mounting recess 6, the slide flange 15*b* of the engaging pin 15 loosely inserted in the slider body 48 is guided to slide, while abutting against the first stage portion 56 by the switching lever 59 flush therewith. At this time, the engaging shaft 15*a* does not project outwardly from the slider body 48, and hence it does not engage with the link plate 12 as shown in FIG. 10. On the other hand, when the external equipment 2 is placed in the mounting recess 6, the slide flange 15*b* is guided to slide while abutting against the second stage portion 58 by the switching lever 59 lying flush therewith. At this time, as shown in FIG. 1, the engaging shaft 15*a* projects outwardly from the slider body 48, passes through a first clearance hole 62 and engages an elongated hole 12*a* made in the top end portion of the link plate 12.

As illustrated in FIG. 12, the lock guide chamber 13*b* includes a lock guide groove 63, along which is guided lengthwise thereof a locking block 17 having engaging stepped portion 17*a* formed in one side thereof. The locking block 17 has a pin which passes through a second clearance hole 64 open to the under cover 13*d* and loosely engages the elongated hole 12*b* of the link plate 12 so that the locking block slides along the lock guide groove 63 as the link plate 12 turns.

In FIG. 1, reference numeral 19 denotes a locking plate which has an engaging pawl 19*a* for engagement with the stepped portion 17*a* of the locking block 17. The locking plate 19 is energized by a compression spring 21 so that it enters the lock guide groove 63 through a recess 65 cut in the rear end portion of the lock guide chamber 13*b*. When the link plate 12 is turned to bring the connector unit 9 in reach of a position for connection with external equipment as described later, the locking plate 19 engages the stepped portion 17*a* of the locking block 17 sliding in association with the link plate 12 and thus, the return movement of the locking block 17 is limited. Furthermore, the locking plate 19 has an unlocking lever 22 formed integrally therewith and projecting outwardly from the rear end of the case body 3. By actuating the unlocking lever 22 downwardly in FIG. 1 against the compression spring 21, the locking plate 19 is brought down to be disengaged from the stepped portion 17*a* of the locking block 17.

Incidentally, the above-mentioned first and second clearance holes 62 and 64 are intended to allow the shaft 15*a* and the pin 18 to move therethrough, without interference with the under cover 13*d* when the operating lever 11 is actuated.

Next, a description will be given of the connector unit which is moved by the above operating mechanism and a guide unit 26 for guiding the movement of the connector unit 9.

Since the connector unit 9 is pivotally secured at its rear end portion to the coupling plate 8 by the pair of rotary shafts 37*d* inserted in the holes 8*e* made in the pair of arms 8*d* as described previously, the connector unit 9 moves horizontally along the underside of the top case half 3*b* as the coupling plate 8 moves.

Figure 21:
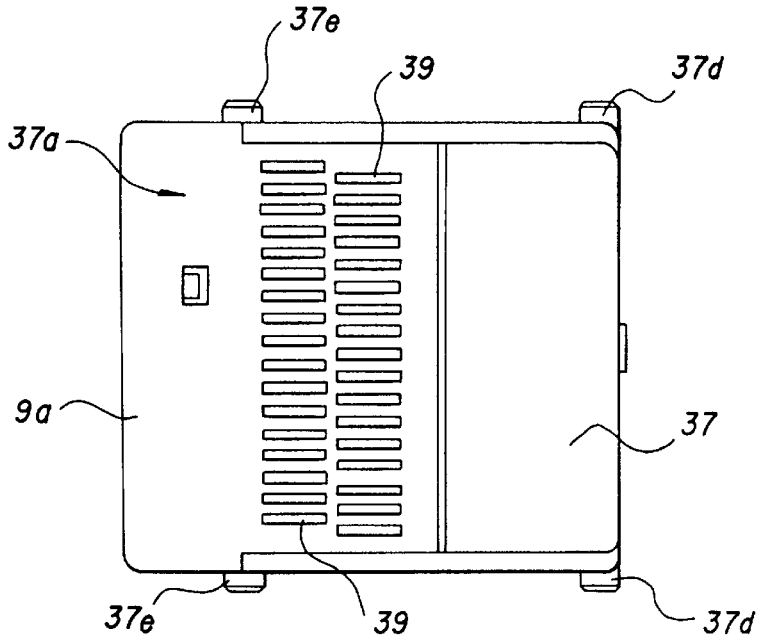
FIG. 21 is a plan view of the connector unit 9.
Figure 22:
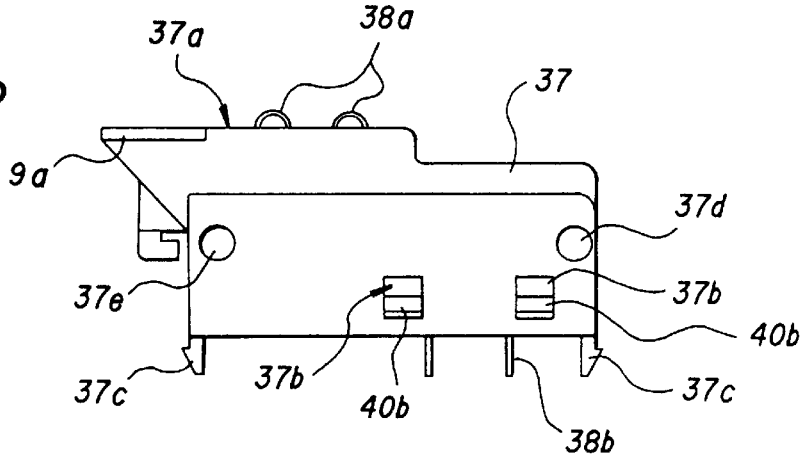
FIG. 22 is a side view of the connector unit 9.
Figure 23:
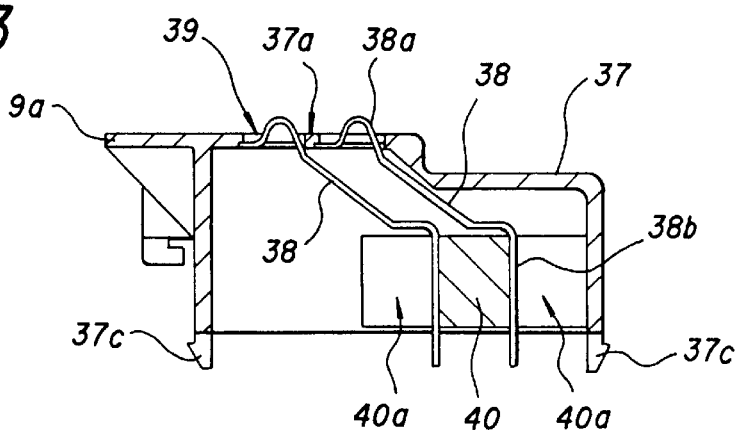
FIG. 23 is a longitudinal-sectional view of the connector unit 9.

As depicted in FIGS. 21 through 23, the connector unit 9 is made up of a connector housing 37, an insulator 40 disposed therein, and a plurality of movable terminals 38 supported by the insulator 40. In the connection surface 37*a* formed in the top of the connector housing 37 there are formed two rows of staggered slits 39. These slits 39 are formed in a one-to-one correspondence with fixed terminals 5 of the external equipment 2 and contact portions 38*a* of the movable terminals 38 project outwardly through the slits 39. The front end of the connection surface 37*a* forms a press portion 9*a* which abuts against an actuating piece 32 described later on.

On both sides of the connector housing 37, there are provided, at the same height as and forward of the pair of rotary shafts 37*d*, a pair of columnar protrusions 37*e* for engagement with cam grooves 30 described later on. Each movable terminal 38 has its tip end portion bent into a U-shape and hence, it is elastic in the direction in which it projects outwardly from the slit 39 of the connector housing 37 for good contact with the corresponding fixed terminal 5 to establish an electrical connection therebetween.

The insulator 40 made of synthetic resin has two rows of staggered terminal receiving grooves 40*a*, in which legs 38*b* of the movable terminals 38 are inserted and supported in place. The insulator 40 having movable terminals 38 thus supported in the grooves 40*a* is inserted into the connector housing 37 from under it. When the insulator 40 is thus mounted in the connector housing 37 with protrusions 40*b* on both sides of the insulator 40 engaged with holes 37*b* of the connector housing 37, the contact portion 38*a* of each movable terminal 38 projects out from the corresponding slit 39 and the leg 38*b* of the movable terminal 38 outwardly projects downwardly through the groove 40*a*.

The connector unit 9, which has the insulator 40 and the movable terminals 38 thus built-in, is mounted on a carrier 42 as shown in FIG. 19. That is, carrier gripping pawls or locking pawls 37*c* of the connector housing 37 engage with the underside of the carrier plate 41 via holes made therein and projecting end portions of the legs 38*b* of the movable terminals 38 passing through the receiving holes 40*a* are soldered to patterns (not shown) on the carrier plate 41. In this way, the connector unit 9 is fixedly mounted on the carrier plate 41.

On the carrier plate 41, a flexible printed circuit board (hereinafter identified as FPC) 43 is connected via a board connector 42 disposed on the carrier plate 41. Thus, the movable terminals 38 of the connector unit 9 are each electrically connected to a circuit element (not shown) in the station 1 via the pattern of the carrier plate 41, the connector 42 and the FPC 43. The reason that the movable terminals 38 are connected via the FPC 43 to the circuit elements in the station 1 is because the carrier plate 41 moves in the station 1 together with the connector unit 9 which supports the movable terminals 38.

Figure 20:
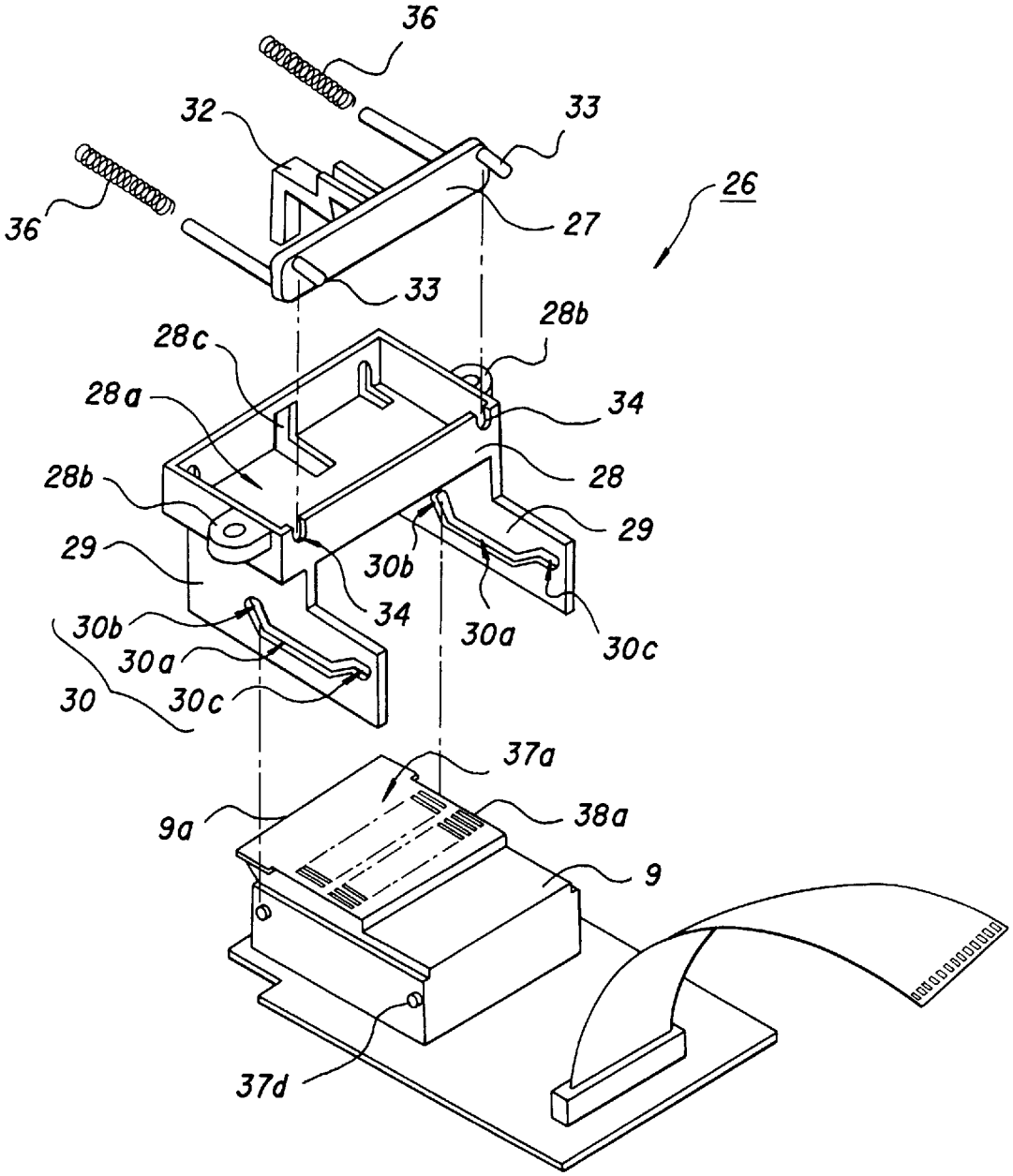
FIG. 20 is an exploded perspective view showing the assembling of a guide unit 26 and the connector unit 9.

The guide unit 26 is mounted on the top case half 3*b* as a unitary structure therewith and, as shown in FIG. 20, it is composed of a box-shaped guide unit body 28 having an upwardly opening recess 28*a*, and a pair of L-shaped guide pieces 29 extending downwardly from the underside of the guide unit body 28 in a manner to hold the connector unit 9 therebetween. The L-shaped guide pieces 29 each have the cam groove 30 formed by a horizontal guide groove 30*a* and first and second inclined grooves 30*b* and 30*c* each communicating with the adjacent groove. The first inclined groove 30*b* extends obliquely upwardly from the front end of the horizontal guide groove 30*a* parallel to the top case half 3*b*. The second inclined groove 30*b* extends obliquely upwardly from the rear end of the horizontal guide groove 30*a*.

The guide unit 26 of such a structure is fixedly mounted on the case body 3 by screws 44 which are threadably attached to the top case half 3*b* through flanges 28*b* of the guide unit 28. In this state, the rearward portions of the L-shaped guide pieces 29 lie along both side marginal edges of an opening 7 of the case body 3 and the second inclined grooves 30*c* also lie under both sides of the opening 7. On the other hand, the first inclined grooves 30*b* are in the case body 3 covered with the top case half 3*b* at a position further to the front than the opening 7 (see FIG. 24).

In the recess 28*a* of the guide unit body 28, a positioning plate 27 is housed as shown in FIG. 20. The positioning plate 27 has an L-shaped actuating piece 32 formed integrally therewith at the front thereof. The actuating piece 32 outwardly projects downwardly between the L-shaped guide pieces 29 under the guide unit body 28 through a guide hole 28*c* made therein.

The positioning plate 27 has a pair of positioning pins extending backwardly from its back at upper positions, which slide on U-shaped grooves 34 cut in the upper edge of the rear wall of the guide unit body 28. Accordingly, the positioning plate 27 slides back and forth in the recess 28*a*, with the actuating piece 32 guided into the guide hole 28*c* and the positioning pins 33 on the U-shaped grooves 34.

The positioning plate 27 is energized backwardly by compression springs disposed between it and the front wall of the guide unit body 28. When no external force is applied to the guide unit 26, the positioning plate 27 abuts against the rear wall of the guide unit body 28 and the tip end portions of the positioning pins 33 horizontally project outwardly above the opening 7 through holes 35 made in the top case half 3*b*. On the other hand, when the actuating piece 32 abuts against the press portion 9*a* of the connector unit 9 at the front thereof and moves forwardly, the positioning plate 27 integral with the actuating piece 32 also moves forwardly in the recess 28*a* and the top end portions of the positioning pins 33 go back into the through holes 35 of the top case half 3*b*.

Next, the operation of the connecting apparatus 1 of the above construction will be described.

As depicted in FIG. 5, when the external equipment 2 is not placed in the mounting recess 6, the sensor pin 45 projects outwardly into the recess 6 and the switching lever 59, integral with the sensor pin 45, is flush with the first stage portion 56. When the operating lever 11 is not being actuated, the slide flange 15*b* of the engaging pin 15 lies on the switching lever 59. At this time, the switching lever 59 is flush with the first stage portion 56 as referred to above and, if the slider body 48 is moved by actuating the operating lever 11, the slide flange 15*b* slides on the first stage portion 56 while abutting against it. In this instance, since the engaging shaft 15*a* does not project outwardly from the slider body 48, the engaging pin 15 does not engage with the link plate 12.

With such an arrangement, even if the actuating lever 11 is indiscriminately actuated, no driving force is transmitted to the link plate 12 and the parts associated with the link plate 12, such as the coupling plate 8 and the connector unit 9, do not move, either and hence, their durability will not be compromised due to wear and fatigue. Moreover, since the movable terminals 38 remain retracted in the case body 3, they will not be shorted or deformed by a foreign matter.

Figure 24:
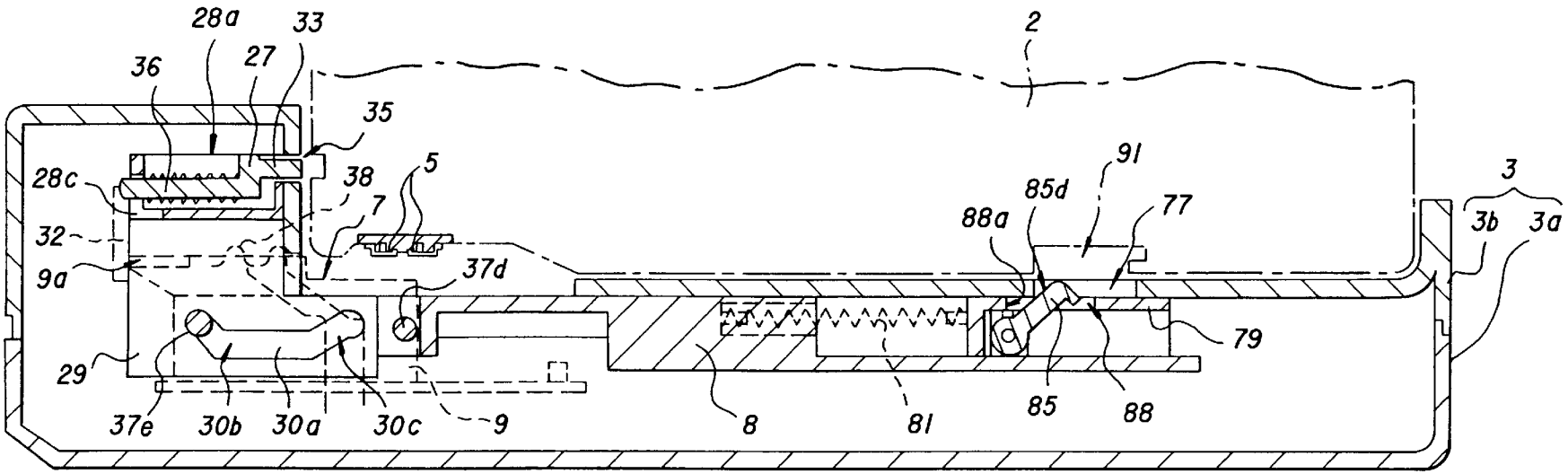
FIG. 24 is a longitudinal-sectional view of the connecting apparatus 1 with the connector unit 9 held at its retracted position and locking hooks 85 held at their initial position.

In this state, as shown in FIG. 24, the connector unit 9 remains retracted in the case body 3 and the coupling plate 8 is energized forwardly by the return spring 14 and hence, lies at the foremost position (the left-hand side in FIG. 24). At this time, the operating plate 79 received in the guide recess 78 is energized by the compression springs 81 and held in abutment with the stopper 82 and the locking hooks 85, supported by the operating plate 79, are at the initial position where their backs 85*d* abut against the underside of the case body 3 in the hook receiving holes 77.

The connector unit 9 pivotally secured to the coupling plate 8 is also energized forwardly and the protrusions 37*e* are at the upper end portions of the first inclined grooves which are the foremost ends of the cam grooves. At this retracted position, the rotary shafts 37*d* and protrusions 37*e* are substantially on the same elevational level with each other and the movable terminals of the connector unit 9 remain retracted in the case body 3 covered with the top case half 3*b*. Further, the top surfaces of the rearward portion of the connector unit 9 and the forward portion of the coupling plate 8 are exposed in the opening 7 of the top case half 3*b*.

The press portion 9*a* of the connector unit 9 abuts against the actuating piece 32 to urge it forward against the compression spring 36 which energizes it backwardly. Accordingly, the positioning plate 27, integral with the actuating piece 32, also moves forward in the recess 28*a* and the top end portions of the positioning pins 33 are held back in the through holes 35 of the top case half 3*b*.

With such a structure, when the external equipment 2 is not placed in the recess 6, either one of the locking hooks 85 and the positioning pins 33 stay in the case body 3, allowing the external equipment 2 to be mounted in the recess 6 vertically from above. Moreover, since the locking hooks 85 do not project outwardly into the recess 6 at this time, they will not be deformed by the external equipment 2 and the external equipment 2 will not be damaged by the locking hooks 85 and the positioning pins 33.

Figure 2:
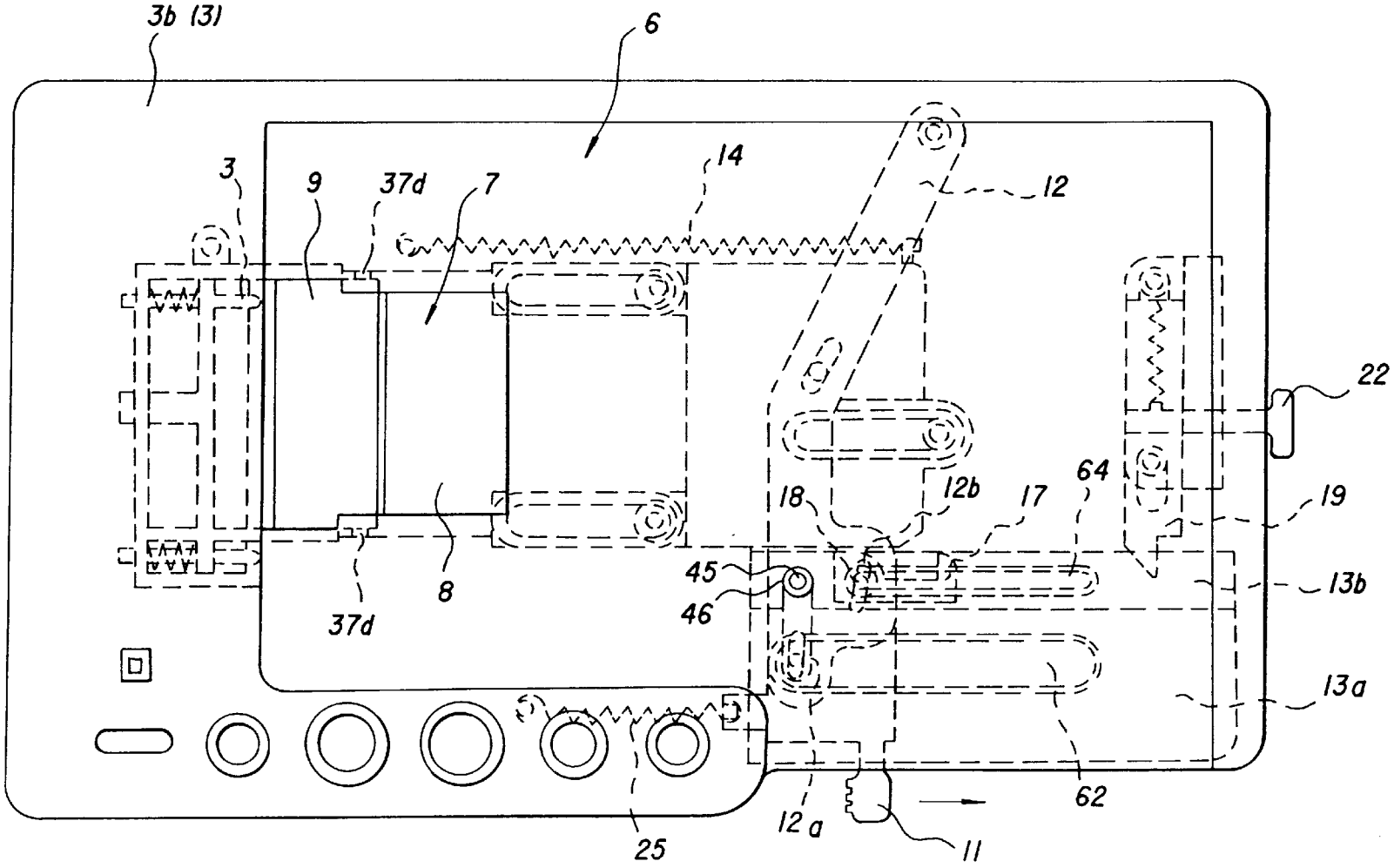
FIG. 2 is a plan view of the connector unit 9 in FIG. 1.

Incidentally, the link plate 12 is at the position shown in FIGS. 1 and 2 and the pin 18 engages the elongated hole 12*b* of the link plate 12 at this time. Hence, the locking block 17 lies at the foremost position in the lock guide groove 13*c*. Thus, when the external equipment 2 is not placed in the recess 6, even if the operating lever 11 is actuated, the locking block 17 will not move backward and hence, the locking mechanism will not work uselessly. Accordingly, even if the operating lever 11 is indiscriminately moved back and forth, the locking mechanism will not get damaged.

When the external equipment 2 is placed in the mounting recess 6, the sensor pin 45 goes back into the case body 3 and the switching lever 59 goes down until it becomes flush with the second stage portion 58 as shown in FIG. 11. When the operating lever 11 is not being actuated, the slide flange

15*b* of the engaging pin 15 is pressed by the positioning spring 25 against the underside of the switching lever 59 and is guided by the switching lever 59 to the position where it slides while abutting the second stage portion 58. In this state, as shown in FIGS. 7 to 9, the engaging shaft 15*a* projects outwardly from the slider body 48 and engages the elongated hole 12*a* of the link plate 12 through the first clearance hole 6 open to the under cover 13*d*.

Figure 7:
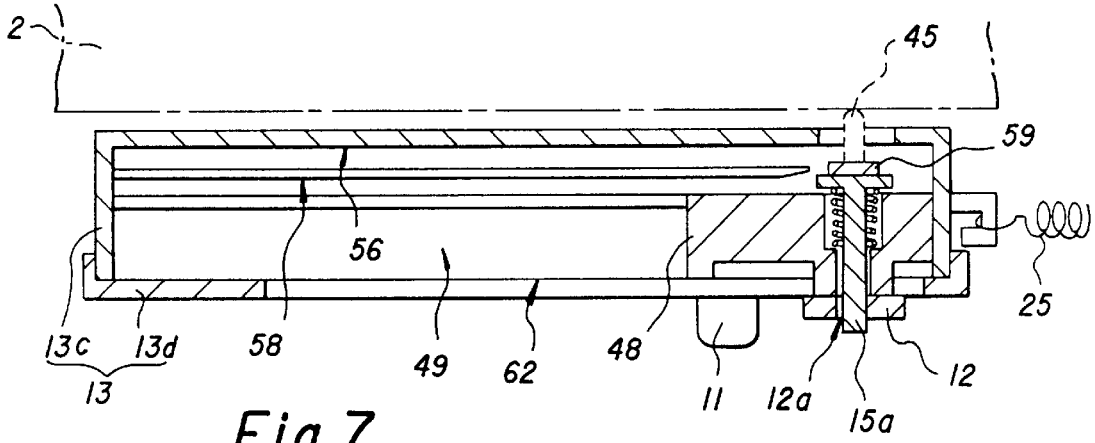
FIG. 7 is a longitudinal-sectional view of the guide case 13, with external equipment mounted.
Figure 8:
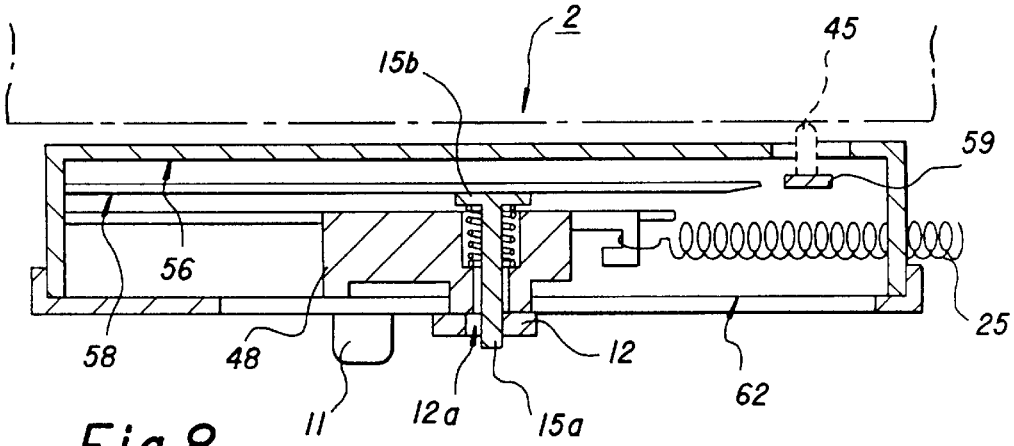
FIG. 8 is a longitudinal-sectional view of the guide case 13, with the operating lever 11 actuated in the state of FIG. 7.
Figure 9:
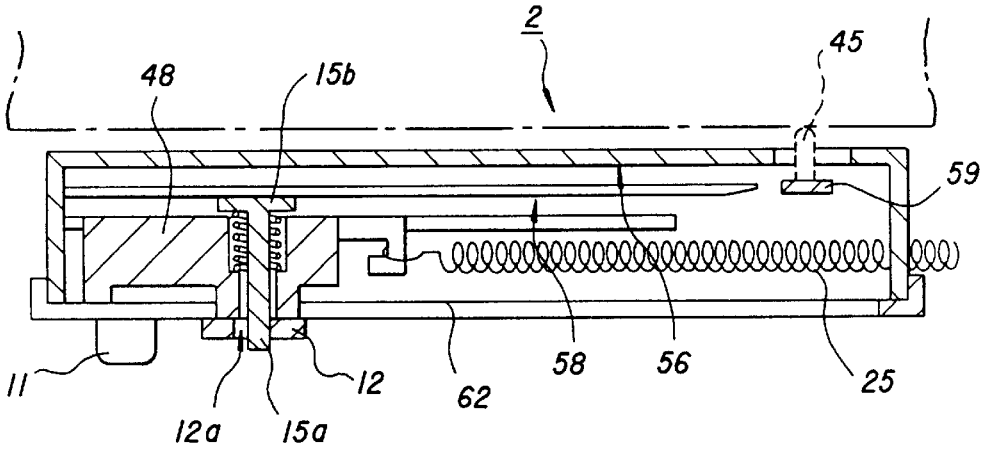
FIG. 9 is a longitudinal-sectional view of the guide case 13, with the operating lever 11 actuated to bring the connector unit 9 to its connecting position in the state of FIG. 8.

When the operating lever 11 is moved from the position in FIG. 7 to the position in FIG. 8 against the return spring 14 and the positioning spring 25, the engaging pin 15 engages the elongated hole 12*a* and the link plate 12 turns about the pivot pin 4 clockwise as shown in FIG. 1. As the link plate 12 turns, locking block 17 and the coupling plate 8 move to the right as shown in FIG. 1. In this instance, unlike in the prior art which uses a press spring for pulling back movable terminals toward the connector unit, the actuation of the operating lever 11 is free from any strong spring action and leverage is utilized. Hence, the operating lever 11 can easily be actuated without any difficulty.

Figure 25:
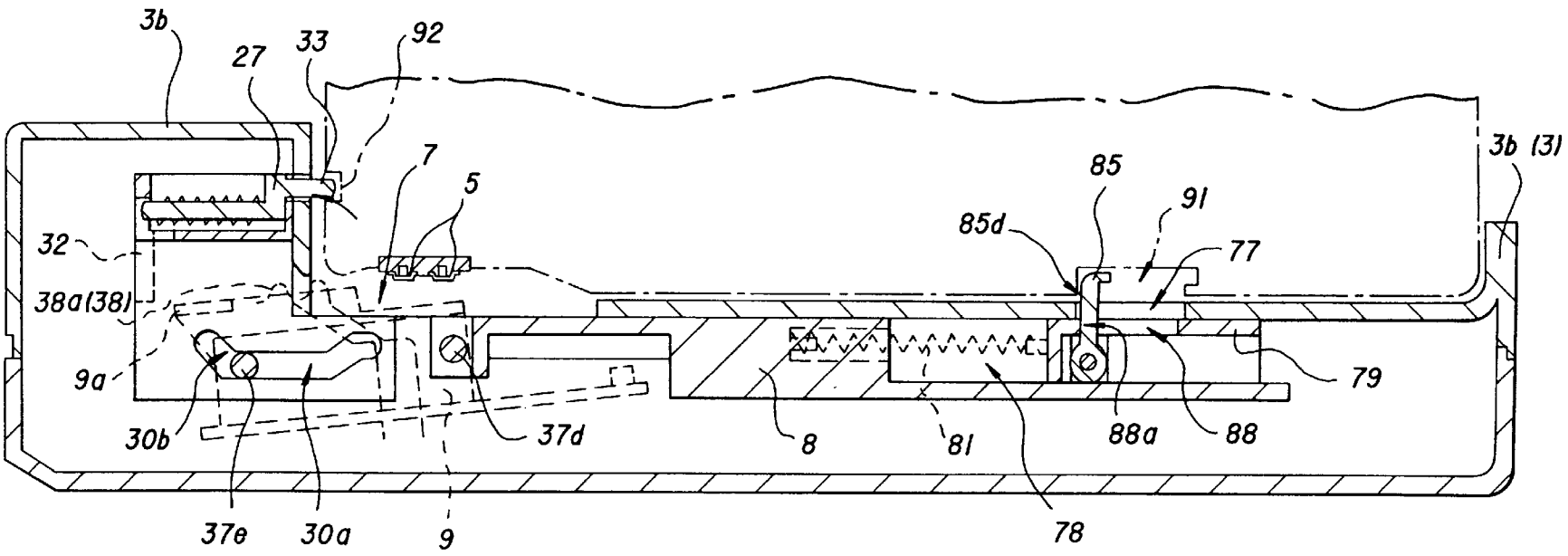
FIG. 25 is a longitudinal-sectional view of the connecting apparatus 1 with the connector unit 9 moved from its retracted position and with locking hooks 85 standing up.

The coupling plate 8 slides along the underside of the top case half 3*b* in parallel thereto by means of the engagement of the guide pins 10*a*, 10*b* and 10*c* with the elongated holes 8*a*, 8*b* and 8*c*. In this way, the operating plate 79 housed in the guide recess 78 of the coupling plate 8 is not acted upon by any particular external force which overcomes the elasticity of the compression springs 81 and hence, it slides on the underside of the case body 3 together with the coupling plate 8. As a result of this sliding movement, the operating plate 79 reaches such a position as shown in FIG. 25, wherein the slits 88 lie just under the hook receiving holes 77, and the locking hooks 85 are turned by the coiled springs 87 in the hook receiving holes 77 counterclockwise in FIG. 25 until their backs 85*d* come into abutment with the stoppers 88*a* in the slits 88. In this state, the locking hooks 85 stand upright with their top end portions partly inserted in the engaging holes 91 of the external equipment 2.

By the sliding movement of the coupling plate 8, the rotary shafts 37*d* of the connector unit 9 inserted in the holes 8*e* of the coupling plate 8 are also translated backwardly and at the same time, each of the protrusions 37*e* move from the first inclined groove 30*b* to the horizontal guide groove 30*a*. When the protrusions 37*e* are engaged with the horizontal guide grooves 30*a*, the connection surface 9*b* of the connector unit 9 tilts forwardly, and consequently, the contact portion 38*a* of the movable terminals 38 projecting outwardly from the connection surface 9*b* moves toward the opening 7 without interference with the top case half 3*b* at the boundary between the connector unit 9 and the opening 7. At this time, since the connector unit 9 itself moves forward, the pressure applied by the press portion 9*a* to the actuating piece 32 is removed and the positioning plate 27 is pushed backward by the compression springs 36 until it abuts the rear wall of the guide unit body 28. Thus, by this movement of the positioning plate 27, the top end portions of the positioning pins 33 pass through the through holes 35 of the top case half 3*b* and horizontally project outwardly to the positions above the opening 7 for engagement with engaging portions 92 of the external equipment 2.

Figure 26:
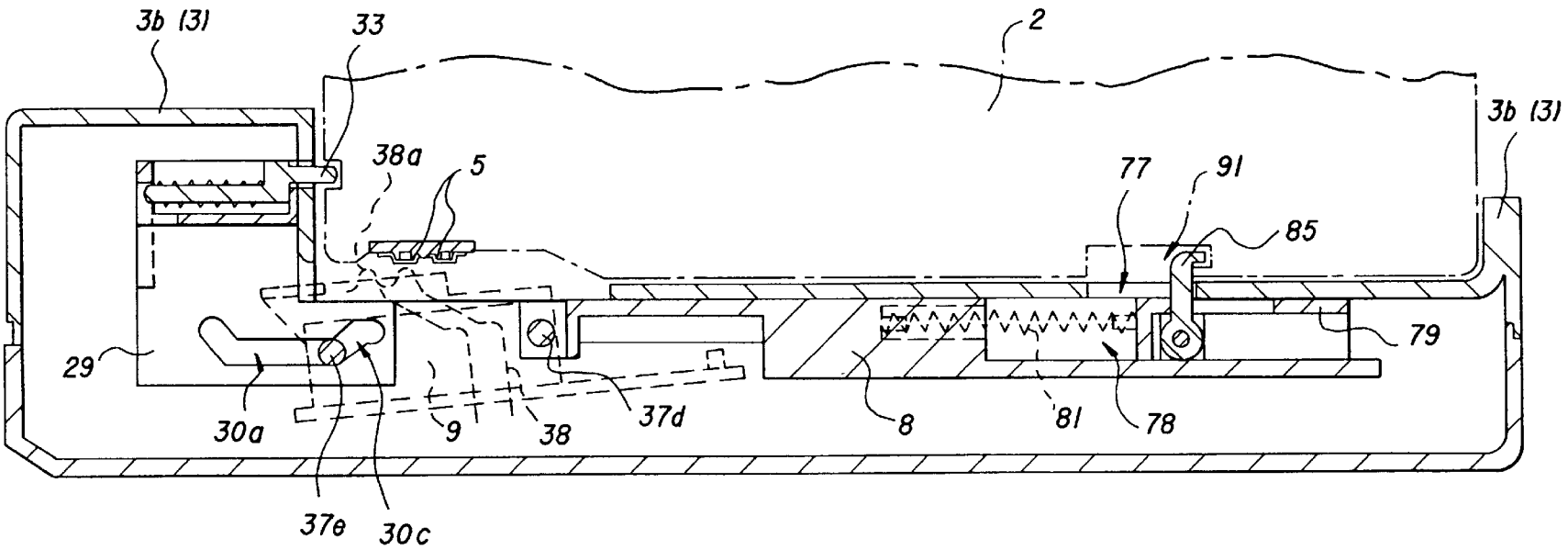
FIG. 26 is a longitudinal-sectional view of the connecting apparatus 1 with the connector unit 9 approaching its connecting position and the locking hooks 85 at their locking position.

When the operating lever 11 is further moved, the operating plate 79 and the coupling plate 8 slide to together and the locking hooks 85 supported by the operating plate 79 move in the hook receiving holes 77, while standing up to the position for their engagement with the holes 91 as depicted in FIG. 26. As a result of this, the external equipment 2 is positioned in the mounting recess 6 and can be prevented from getting out of the bottom of the recess 6, enabling the contact portions 38*a* of the movable terminals to make elastic contact with the fixed terminals 5.

By the above sliding movement of the coupling plate 8, the protrusions 37*e* move backwardly along the horizontal guide grooves 30*a* and the connector unit 9 is translated backwardly with its connection surface 9*b* tilted forward. As shown in FIG. 26, when the protrusions 37*e* go back in the grooves to the position contiguous to the second inclined grooves 30*c*, the contact portions 38*a* of the movable terminals 38 approach the fixed terminals of the external equipment 2 while remaining tilted forward.

At the locking position of each locking hook 85 depicted in FIG. 26, its front 85*c* abuts the forward end wall of the engaging hole 91 and its back 85*c* abuts the stopper 88*a* to thus limit further backward (to the right in FIG. 26) sliding of the operating plate 79. In this state, when further actuating the operating lever 11 from the position in FIG. 8 to the position in FIG. 9 to slide the coupling plate 8 to the position in FIG. 27, the compression springs 81 disposed between the operating plate 79 and the coupling plate 8 are compressed in proportion to the distance of the sliding movement. This produces increased force due to the compressed springs 81 in the increased force is applied to the back 85*d* of each locking hook 85 to further press it against the innermost wall of the hole 91 to further ensure the locking thereof.

On the other hand, when the coupling plate 8 is slid to the position in FIG. 27, the protrusions 37*e* each go back along the second inclined groove 30*c* to its upper end portion which is the rearmost end of the cam groove 30. At this time, the contact portions 38*a*, of the movable contact terminals 38 projecting outwardly from the connection surface 9*b*, slide the surfaces of the fixed terminals 5 from the front obliquely thereto and stand still at the position shown in FIG. 27. In this state, the rotary shafts 37*d* and the protrusions 37*e* have returned to about the same height and the connection surface 9*b* of the connector unit 9 is held horizontally in the opening 7.

At this position of connection, since the top end portions of the positioning pins 33 are in engagement with the engaging parts of the external equipment as mentioned previously, this engagement, coupled with the locking action by the locking hooks 85, limits the vertical movement of the external equipment 2 in the opening 7. This prevents the external equipment 2 from being lifted up from the bottom of the mounting recess 6 by the contact pressure of the movable terminals 38 pressed into contact with the fixed terminals 5 to the external equipment 2, ensuring elastic contact between them. Thus, the fixed terminals 5 of the external equipment 5 and the movable terminals 38 of the connector unit 9 are electrically connected.

Figure 4:
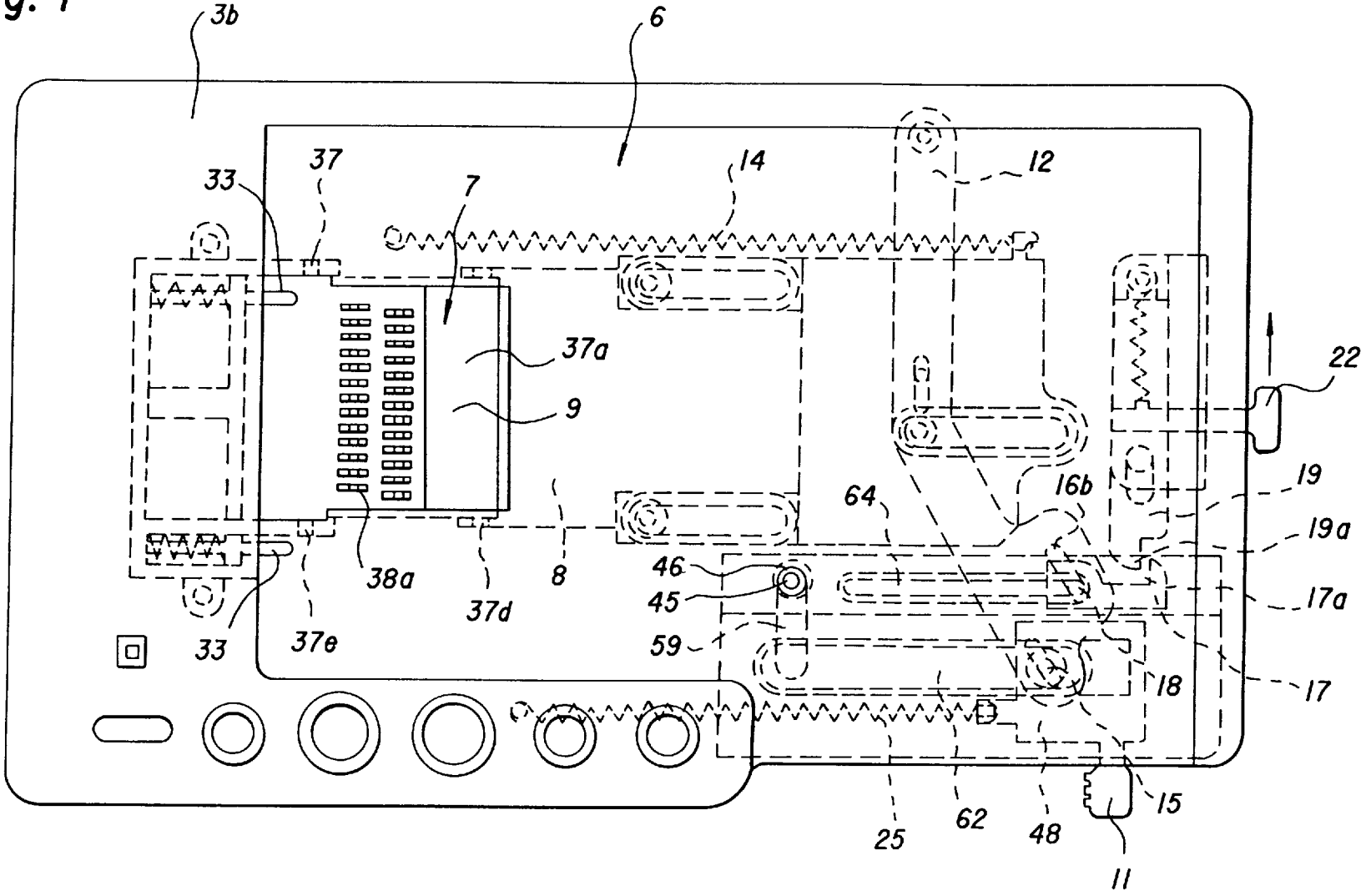
FIG. 4 is a plan view of the connector unit 9 in FIG. 3.

At this time, the operating lever 11 reaches the position shown in FIGS. 3 and 4 and by the turning movement of the link plate 12, the locking block 17 goes back into the lock guide groove 13*c* to the rear end thereof and the locking pawl 19*a* of the locking plate 19 engages with the stepped portion 17*a* of the locking block 17. The locking block 17, thus locked, is inhibited from returning forward, and even if the force applied to the operating lever 11 for actuating it is removed, the link plate 12, engaged with the pin 18 through the elongated hole 12*b*, is restricted from turning counterclockwise in FIGS. 3 and 4 and hence will not return to maintain the connector unit 9 at the position for its connection with the connector of the external equipment 2. Hence, the state in which the movable terminals 38 are in elastic contact with the fixed terminals 5 can be maintained without any operation—this allows the user to perform other manual operations (for video reproduction and charging of batteries, for instance).

In FIG. 3, upon depressing the unlocking lever 22, the locking pawl 19*a* of the locking plate 19 is disengaged from the stepped portion 17*a*, permitting forward movement of the locking block 17. Hence, the link plate 12 turns counterclockwise by the action of the return spring 14 and the positioning spring 25, allowing the coupling plate 8 to slide forward along the underside of the top case half 3*b*. By the sliding movement of the coupling plate 8 for return to its initial position, the operating plate 79 and the locking hooks 85 return to the positions shown in FIG. 24 in reverse order to the afore-mentioned.

That is, while the coupling plate 8 moves from the position in FIG. 27 to the position in FIG. 26, the locking hooks 85 remain engaged with the external equipment 2 and the compression springs 81 gradually elongates. When the coupling plate 8 slides from the position in FIG. 26 to the position in FIG. 25, the operating plate 79 is pressed by the stopper 82 and is slid forwardly together with the coupling plate 8 and each of the locking hooks 85, while standing up, moves forwardly from its locking position in the hook receiving hole. When the coupling plate 8 slides from the position in FIG. 25 to its retracted position in FIG. 24, the back 85*d* of each of the locking hooks 85 abut the marginal edge of the hook receiving hole and, by the forward sliding of the operating plate 70 associated with the sliding of the coupling pate 8, the locking hook 85 turns clockwise as shown in FIG. 24 to an initial position where each of the locking hooks 85 abuts the underside of the case body 3.

By this sliding movement of the coupling plate 8, the rotary shafts 37*d* of the connector unit 8 at the rearward portion thereof are horizontally pushed forwardly and the protrusions 37*e* move along the cam grooves 30 from their rearmost to foremost ends. With this movement, the connector unit 9 returns to its retracted position, following the afore-mentioned locus of movement. Consequently, the contact portions 38*a* of the movable terminals 38 projecting out from the connection surface 37*a* move into the case body 3 without interference with the top case half 3*b* at the boundary between the connector unit 9 and the opening 7 as described previously. Further, as the link plate 12 turns, the slide flange 15*b* of the pin 15 engaging with the link plate 12 slides onto the switching lever 59 as depicted in FIG. 7.

When the connector unit 9 returns to its retracted position, the press portion 9*a* at its front end again abuts the actuating piece 32 as shown in FIG. 24 and pushes it forward, retracting the positioning pins 33 into the through holes 35. Thus, the positioning pins 33 are disengaged from the external equipment 2, enabling the external equipment 2 to be taken out from the mounting recess 6 of the station 1 without interference with the positioning pins 33.

When the external equipment 2 is taken out, the top end of the sensor pin 45 again projects outwardly into the mounting recess 6 by the action of the spring 61 and the switching lever 59 also moves up in association with the sensor pin 45. At the same time, the engaging pin 15 pressed against the underside of the switching lever 59 by the spring 52 returns to a position flush with the first stage portion 56 as shown in FIG. 5.

The present invention is not limited specifically to the embodiments described above and various modifications can be effected as described below.

While the first stage portion 56 has been described to be the inner top of the slide guide groove 49, it may also be defined by guide ribs that project protrusively on both side walls of the slide guide groove 49 as is the case with the second stage portion 58.

As described above, the connector unit 9 is moved from its retracted position in the case body 3 to the position to bring the movable terminals 38 into contact with the fixed terminals 5 of the external equipment 2. But it is also possible to employ a conventional structure in which the connector unit 230 is moved by the operating lever 11 to press the lever 25 to bring the movable terminals 400 into contact with the fixed terminals of the external equipment as described previously with reference to the prior art.

The switching mechanism and the locking mechanism need not always be housed in the guide case 12. For example, it is possible to use a construction in which the first and second stage portions 56 and 58 are formed in the slide guide groove 49 formed directly in the case The locking mechanism for locking the link plate 12 at the position of connection of the connector unit 9 need not always act directly upon the link plate 12, but instead it may also be a mechanism which limits the movement of the parts operatively associated with the link plate 12, such as the coupling plate 8 and the connector unit 9.

While as described above, the operating lever 11 and the connector unit 9 have been described to be linked via the link plate 12 and the coupling plate 8, it is also possible to form a recess in the connector unit 9 for direct engagement with the pin 15, omitting either one of the link plate 12 and the coupling plate 8 or both.

The locking hooks 85 need not always be engaged with the holes 91 in the underside of the external equipment 2. But they may also be engaged with holes in side surfaces of the external equipment 2 as long as they are inside the mounting recess 6.

Although the coiled springs 81 have been described above to be used to press the operating plate 79 against the stopper 82, they may be replaced with tension springs. In such an instance, the tension springs are disposed at positions symmetrical to the positions of the compression springs 81 with respect to the stopper 82.

Additionally, the engagement of the positioning pins 33 with the corresponding receiving holes 92 of the external equipment 2 is intended to further ensure the positioning of the external equipment 2 and this engagement may be omitted when the locking by the locking hooks 85 suffices.

It will be apparent that many modifications and variations may be effected without departing from the scope of the novel concepts of the present invention.

What is claimed is:

1. A connecting apparatus comprising:

a case body (1) for detachably mounting external equipment (2) in a mounting recess (6) of said case body (1);

a connector unit (9) electrically connected to a connector of said external equipment (2); and an operating mechanism for any one of direct and indirect engagement with said connector unit, wherein when said external equipment (2) is placed in said mounting recess (6), said operating mechanism is actuated to connect said connector unit (9) to said connector of said external equipment (2);

wherein said operating mechanism comprises:

an operating lever (11) projecting outwardly from said case body (3);

a slider body (48) formed integrally with said operating lever (11) and guided to be horizontally movable in a slide guide groove (49) formed in said case body (3);

an engaging pin (15) composed of an engaging shaft (15*a*) loosely inserted in a through hole (51) bored through said slider body (48) and a slide flange (15*b*) formed integrally with said engaging shaft (15*a*) at a base end thereof;

a compression spring (52) disposed between said slide flange (15*b*) and said slider body (48), for energizing said slide flange (15*b*) toward an inside of said slide guide groove (49);

a first stage portion (56) provided in an interior surface of said slide guide groove (49), for horizontally guiding said slide flange (15*b*);

a second stage portion (58) provided in said interior surface of said slide guide groove (49) in parallel to said first stage portion (56), for horizontally guiding said slide flange (15*b*) at a height different from the position of guiding by said first stage portion (56);

a sensor pin (45) forced to project outwardly into said mounting recess (6) through said case body (3);

a switching lever (59) operatively associated with said sensor pin (45) to vertically move at a first end of said slide guide groove (49) in such a manner as to be flush with said first stage portion (56) when said sensor pin (45) projects outwardly into said mounting recess (6) and to be flush with said second stage portion (58) when said sensor pin (45) is retracted into said case body (3); and a positioning spring (25) for energizing said slider body (48) toward said first end of said slide guide groove (49) so that said slide flange (15*b*) slides onto said switching lever (59);

wherein when said sensor pin (45) is pressed into said case body (3) by said external equipment (2) mounted in said mounting recess (6), said engaging pin (15) being forced by said compression spring (52) is guided while simultaneously being pressed against said second stage portion (58) and said engaging shaft (15*b*) projects outwardly from said slider body (48) and into any one of direct and indirect engagement with said connector unit (9); and wherein when said sensor pin (45) projects outwardly and is retracted into said mounting recess (6), said engaging pin (45) forced by said compression spring (52) is guided while simultaneously being pressed against said first stage portion (56) and said engaging shaft (15*a*) is retracted into said slider body (3).

2. The apparatus of claim 1, wherein said connector unit (9) is connected to an intermediate portion of a link plate (12) pivotally secured at a base end thereof to said case body (3);

wherein said engaging shaft (15*a*), projecting outwardly from said slider body (48), engages an elongated hole (12*a*) made in a free end portion of said link plate (12); and wherein said connector unit (9) is moved by actuation of said operating lever from a retracted position in said case body (3) to a position for connection to said external equipment (2).

3. The apparatus of claim 2, wherein said connector unit (9) is forced by a return spring (14) to move to said retracted position; and wherein a locking mechanism (17) is provided to lock said link plate (12) at a position where said link plate (12) has been turned so that said connector unit (9) is in a position to be connected against said return spring (14).

4. The apparatus of claim 3, said locking mechanism comprising:

a locking block (17) guided horizontally in a lock guide groove (63) formed in said case body (3);

a pin (18) provided to protrude from said locking block (17) for engagement with said link plate (12); and a locking plate (19) for locking said locking block (17) at a position where said link plate (12) has been fully turned;

wherein said slide guide groove (49) and a lock guide groove (63) are disposed side by side in a guide case (13) along a back portion of said mounting recess (6) between said mounting recess (6) and said link plate (12); and wherein said engaging shaft (15*b*), projecting outwardly from said slider body (48), and said pin (18), protruding from said locking block, (17) both engage said link plate (12).

5. A connecting apparatus which positions external equipment (2) mounted in a mounting recess (6) of a case body (3) and connects a built-in connector unit (9) to a connector of said external equipment (2) to establish an electrical connection therebetween, said connecting apparatus comprising:

a case body (3) having hook receiving through holes (77) extending from said mounting recess(6) to said case body (3);

an operating plate (79) manually operated to slide along an underside of said case body (3) below said hook receiving holes (77);

locking hooks (85) each having a top end portion thereof bent substantially at right angles to form an L-shape and each being pivotally secured at a base end thereof to said operating plate (79) at a position where said L-shaped top end portion partly enters one of said hook receiving holes as said operating plate (79) slides;

twisted coiled springs (87) mounted on said operating plate (79), for forcing said locking hooks to turn front to back;

stoppers (88*a*) formed integrally with said operating plate (79), for limiting a turning movement of said locking hooks (85) when said locking hooks (85) stand up perpendicularly to a direction of sliding movement of said operating plate (79); and wherein said external equipment (2), mounted in said mounting recess (6), is positioned by sliding said operating plate (79) from an initial position where a back portion of each of said locking hooks (85) abuts said underside of said case body (3) to a position where each of said locking hooks (85), stand up in one of said hook receiving holes (77), engages an engaging groove (91) of said external equipment (2).

6. A connecting apparatus which positions external equipment (2) mounted in a mounting recess (6) of a case body (3) and connects a built-in connector unit (9) to a connector of said external equipment (2) to establish an electrical connection therebetween, said connecting apparatus comprising:

a case body (3) having hook receiving through holes (77) extending from said mounting recess(6) to said case body (3);

an operating plate (79) manually operated to slide along an underside of said case body (3) below said hook receiving holes (77);

locking hooks (85) each having a top end portion thereof bent substantially at right angles into an L-shape and each being pivotally secured at a base end thereof to said operating plate (79) at a position where said L-shaped top end portion partly enter one of said hook receiving holes as said operating plate (79) slides;

twisted coiled springs (87) mounted on said operating plate (79), for forcing said locking hooks to turn front to back;

stoppers (88*a*) formed integrally with said operating plate (79), for limiting a turning movement of said locking hooks (85) when said locking hooks (85) stand up perpendicularly to a direction of sliding movement of said operating plate (79);

a coupling plate (8) having an upwardly opening guide recess (78) for slidably guiding therein said operating plate (79);

coiled springs (81) stretched between said coupling plate (8) and said operating plate (79), for forcing said operating plate (79) into abutment with a stopper (82) mounted upright on said coupling plate (8);

a coupling plate operating means for sliding said coupling plate (8) in parallel with said direction of sliding movement of said operating plate (79) to slide said coupling plate (8) past said coiled springs (81); and wherein said operating plate (79) is slid, by sliding movement of said coupling plate, from an initial position where a back of each locking hook (85) abuts said underside of said case body (3) to a position where each of said locking hooks (85), standing up in one of said hook receiving holes (77), engages one of engaging grooves (91) of said external equipment (2), and then said coupling plate (8) is further slid to actuate said coiled springs (81) to force each of said locking hooks (85) into engagement with one of said engaging grooves (91), thereby positioning said external equipment (2) placed in said mounting recess (6).

7. The apparatus of claim 6, wherein said connector unit (9) is secured to said case body (3) so that said connect unit (9) is operatively associated with said coupling plate (8) to move back and forth between a retracted position in said case body (3) and a position for connection to a connector of said external equipment (2); and wherein when said connector unit (9) is moved, by sliding movement of said coupling plate (8), from said retracted position to said position for connection to a connector of said external equipment (2), said operating plate (79) slides from said initial position to a locked position and stops at said locked position so that said coiled springs (81) are compressed in proportion to a distance of movement of said coupling plate (8).

* * * * *